US009514679B2

(12) United States Patent
Hayashi et al.

(10) Patent No.: US 9,514,679 B2
(45) Date of Patent: Dec. 6, 2016

(54) DISPLAY DEVICE AND DRIVING METHOD FOR THE SAME

(71) Applicant: JOLED INC., Tokyo (JP)

(72) Inventors: Hiroshi Hayashi, Hyogo (JP); Shinya Ono, Osaka (JP)

(73) Assignee: JOLED, INC., Tokyo (JP)

( * ) Notice: Subject to any disclaimer, the term of this patent is extended or adjusted under 35 U.S.C. 154(b) by 85 days.

(21) Appl. No.: 14/521,127

(22) Filed: Oct. 22, 2014

(65) Prior Publication Data

US 2015/0124004 A1 May 7, 2015

(30) Foreign Application Priority Data

Nov. 1, 2013 (JP) ..... 2013-228632

(51) Int. Cl.
*G09G 3/12* (2006.01)
*G09G 3/32* (2016.01)

(52) U.S. Cl.
CPC .... *G09G 3/3233* (2013.01); *G09G 2300/0842* (2013.01); *G09G 2310/0254* (2013.01); *G09G 2320/0295* (2013.01); *G09G 2320/043* (2013.01)

(58) Field of Classification Search
CPC ..... G09G 3/12; G09G 3/14; G09G 3/30–3/3291
See application file for complete search history.

(56) References Cited

U.S. PATENT DOCUMENTS

2010/0060176 A1* 3/2010 Takahashi ..... G09G 3/3233 315/169.3
2010/0073265 A1 3/2010 Hirai et al.
2014/0168184 A1* 6/2014 Kim ..... G09G 3/3258 345/209
2015/0145845 A1* 5/2015 Nam ..... G09G 3/3233 345/209

FOREIGN PATENT DOCUMENTS

JP 2009-104104 5/2009

* cited by examiner

*Primary Examiner* — Sanghyuk Park
(74) *Attorney, Agent, or Firm* — Greenblum & Bernstein, P.L.C.

(57) ABSTRACT

A display device includes a display unit including luminescence pixels each including a luminescence element and a driving transistor configured to supply a current to the luminescence element to cause the element to emit light, a signal line driving circuit configured to supply a voltage applied between a gate and a source of the driving transistor, and a control circuit configured to apply a certain voltage between the gate and the source of the driving transistor by controlling the signal line driving circuit and the display unit when a power supply to the signal line driving circuit is stopped. The control circuit applies the certain voltage between the gate and the source of the driving transistor so that a recovery of a shift amount of a threshold voltage of the driving transistor is suppressed, the recovery being made when the power supply to the signal line driving circuit is stopped.

15 Claims, 16 Drawing Sheets

DISPLAY DEVICE AND DRIVING METHOD FOR THE SAME

This application claims priority to Japanese Patent Application No. 2013-228632, filed on Nov. 1, 2013, the contents of which are hereby incorporated by reference.

BACKGROUND

1. Technical Field

The present disclosure relates to display devices and driving methods for the same, and more particularly to a display device using current-driven luminescence elements and a driving method for the same.

2. Description of the Related Art

In recent years, organic electro-luminescence (EL) displays based on organic EL have been attracting attention as one type of next-generation flat-panel displays that might replace liquid crystal displays. Active-matrix display devices such as organic EL displays use thin film transistors (TFTs) as driving transistors.

SUMMARY

A threshold voltage of a TFT shifts owing to voltage stress such as voltage applied between the gate and the source at the time of conduction. An amount of the shift may change in the positive or negative direction depending on the gate-source voltage. Because a temporal shift in the threshold voltage causes a variation in an amount of current supplied to an organic EL element, such a temporal shift influences luminance control of a display device and undesirably degrades the display quality.

One non-limiting and exemplary embodiment provides a display device capable of reducing the influence of a temporal shift in a threshold voltage of a driving transistor on luminance control and of suppressing degradation of the display quality, and a driving method for the same.

Additional benefits and advantages of the disclosed embodiments will be apparent from the specification and figures. The benefits and/or advantages may be individually provided by the various embodiments and features of the specification and drawings disclosure, and need not all be provided in order to obtain one or more of the same.

A display device according to an embodiment of the present disclosure comprises: a display unit including luminescence pixels each of which includes a luminescence element and a driving transistor, the driving transistor including a gate electrode, a source electrode, and a drain electrode, and being configured to supply a current to the luminescence element to cause the luminescence element to emit light; a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit in a case where a power supply to the signal line driving circuit is stopped. The control circuit is configured to apply the certain voltage between the gate electrode and the source electrode of the driving transistor so that a recovery of an amount of shift of a threshold voltage of the driving transistor is suppressed, the recovery being made in a period when the power supply to the signal line driving circuit is stopped.

These general and specific aspects may be implemented using a driving method, an electronic device, a system, and an integrated circuit, and any combination of a driving method, an electronic device, a system, and an integrated circuit.

According to the embodiments of the present disclosure, a display device capable of suppressing an error between an actual threshold-voltage shift amount of a driving transistor and an estimated threshold-voltage shift amount estimated from a cumulative amount of stress can be provided. Also a driving method for the same can be provided.

DETAILED DESCRIPTION

First, items that have been studied by the inventors in order to provide embodiments of the present disclosure will be described.

In order to suppress a change in luminance of an organic EL element due to threshold-voltage shifting, there is considered a method for supplying a desired amount of current to an organic EL element by offsetting a video signal voltage to be applied between the gate and the source by a threshold-voltage shift amount (for example, Japanese Unexamined Patent Application Publication No. 2009-104104). Also, as an example of a method for estimating a threshold-voltage shift amount, there is considered a method for estimating a threshold-voltage shift amount on the basis of a cumulative amount of stress of a gate-source voltage ($V_{gs}$) calculated from a log of the video signal voltage. However, an actual operation state of a display is not entirely occupied by an in-operation period but includes a non-operation period. During the non-operation period, the shifted threshold voltage of the TFT sometimes partially recovers depending on the gate-source voltage $V_{gs}$. Such recovery causes an error between the threshold-voltage shift amount estimated on the basis of the cumulative amount of stress and the actual threshold-voltage shift amount, and the error is accumulated with time. In particular, in a non-operation state in which an external power source is disconnected, it is difficult to grasp voltages applied to the gate, drain, source electrodes of the TFT and cumulative application periods therefor because it is difficult to supply electric power to a driving circuit. Accordingly, the estimated threshold-voltage shift amount deviates from the actual threshold-voltage shift amount more with time. For this reason, a desired amount of current is not unfortunately supplied to an organic EL element when a video-signal-voltage offset determined based on the estimated threshold-voltage shift amount is used.

Accordingly, embodiments of the present disclosure provide a display device capable of suppressing an error between the actual threshold-voltage shift amount of a driving transistor and the estimated threshold-voltage shift amount estimated from the cumulative amount of stress, and a driving method for the same.

(Underlying Findings of Present Disclosure)

Prior to a detailed description of the present disclosure, underlying findings of the present disclosure will be described below.

Figure 1:
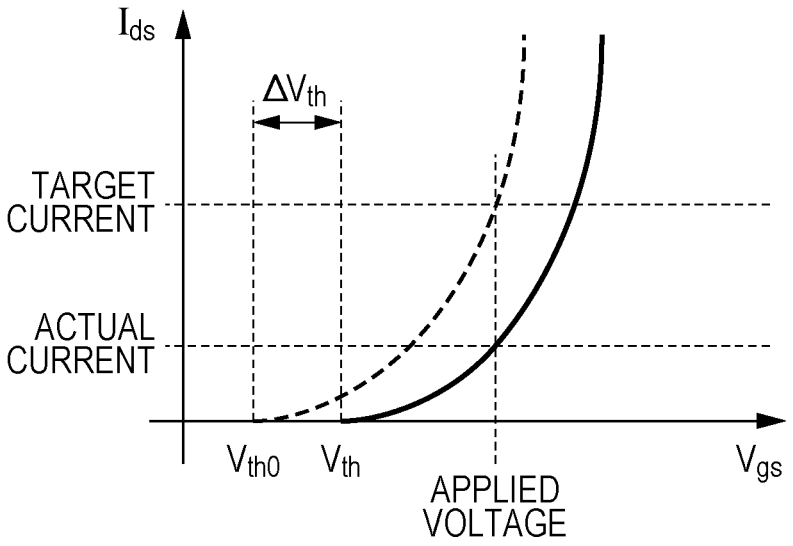
FIG. 1 is a diagram illustrating the overview of transmission characteristics of a TFT.

A threshold voltage of a driving transistor included in a luminescence pixel included in an organic EL display device will be described. A threshold voltage of a driving transistor, which is a TFT, temporally changes while a voltage is being applied. Specifically, in response to application of a bias to the gate electrode of the driving transistor, the gate insulating film receives electrons in the case of positive biasing or holes in the case of negative biasing. Accordingly, positive or negative threshold-voltage shifting occurs. FIG. 1 is a graph illustrating the overview of a relationship (transmission characteristics) between a gate-source voltage $V_g$, (video signal voltage) applied between the gate and the source of the driving transistor and a current $I_{ds}$ (current to be supplied to the organic EL element) that flows between the drain and the source. Referring to FIG. 1, a broken line denotes transmission characteristics of the driving transistor at the start of use, whereas a solid line denotes transmission characteristics after the threshold voltage has shifted owing to application of a voltage. As illustrated in FIG. 1, the threshold voltage of the TFT shifts from $V_{th1}$ to $V_{th}$ owing to application of a voltage between the gate and the source. As a result of this shifting, a target current is no longer obtained if a voltage corresponding to the target current at the start of use is applied after the threshold voltage has shifted. Consequently, a desired amount of current is not to be supplied to the organic EL element.

Figure 2:
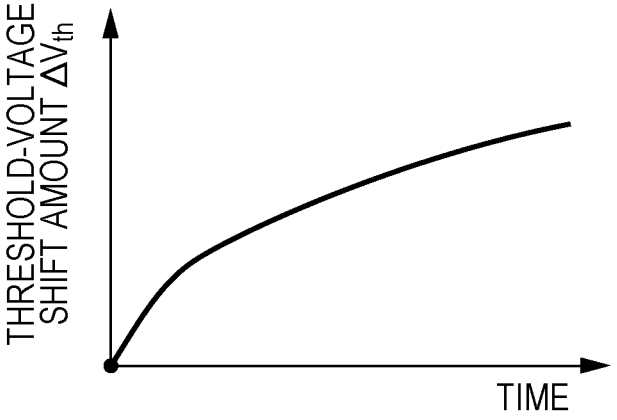
FIG. 2 is a graph illustrating a modeled relationship between a stress application period and a threshold-voltage shift amount of the TFT.

Accordingly, in an organic EL display device according to the underlying findings of the present disclosure, the gate-source voltage $V_{gs}$ is offset by a threshold-voltage shift amount $\Delta V_{th}$ in order to suppress the influence of threshold-voltage shifting on a change in luminance of the organic EL element. The offset of the gate-source voltage $V_{gs}$ is determined on the basis of a cumulative amount of stress applied to the driving transistor, the cumulative amount of stress being calculated from a log of the gate-source voltage $V_{gs}$. For example, a relationship between an application period and the threshold-voltage shift amount $\Delta V_{th}$ obtained when certain stress (gate-source voltage) is applied to the driving transistor is determined from an experiment or the like. Then, the determined relationship is used to create a model for estimating the threshold-voltage shift amount $\Delta V_{th}$ corresponding to the cumulative amount of stress. FIG. 2 is a graph illustrating a modeled relationship between the stress application period and the threshold-voltage shift amount $\Delta V_{th}$. The offset of the gate-source voltage $V_{gs}$ is determined using a model such as the one illustrated in FIG. 2 so that the threshold-voltage shift amount $\Delta V_{th}$ corresponding to the cumulative amount of stress is compensated for.

However, in an actual TFT, the shifted threshold voltage partially recovers while no voltage is being applied. Specifically, when a bias for the gate of the TFT becomes equal to 0 V, thermal energy from the environmental temperature causes electrons or holes in the gate insulating film to move from the gate insulating film, and consequently the shifted threshold voltage recovers. This recovery causes an error between the offset determined based on the cumulative amount of stress and the threshold-voltage shift amount $\Delta V_{th}$, and the error accumulates with time.

Now, a result of an experiment that confirmed recovery of the shifted threshold voltage will be described. In this experiment, a stress application step in which a voltage of 20 V was applied as stress between the gate and the source of the TFT for half an hour and a no-stress application step in which the gate-source voltage of the TFT was kept at 0 V for three hours were alternately performed. In the stress application step, a gate potential $V_g$ was set to 20 V and a source potential $V_s$, and a drain potential $V_d$ were set to 0 V. In the no-stress application step, the gate potential $V_g$, the source potential $V_s$, and the drain potential $V_d$ were set to 0 V. In the experiment, a TFT including a gate insulating film which includes a 220-nm-thick silicon nitride film and a 50-nm-thick silicon oxide film, and a 90-nm-thick semiconductor layer which includes an oxide semiconductor was used. Also, in the experiment, the environmental temperature was kept at 45° C.

The result of the experiment will be described with reference to FIGS. 3 to 8.

Figure 3:
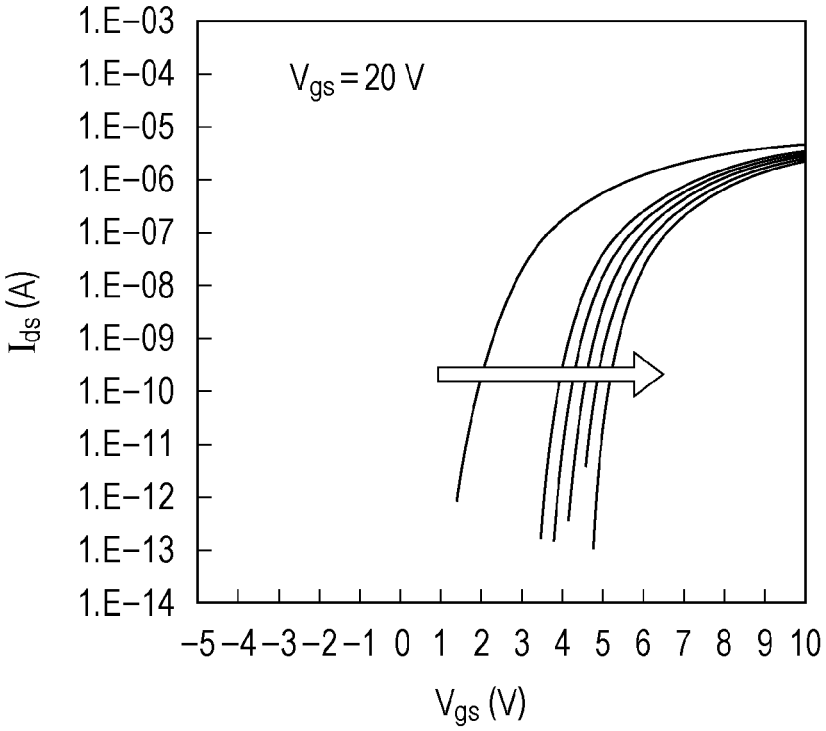
FIG. 3 is a graph illustrating a temporal change in the transmission characteristics of the TFT when stress is applied to the TFT.

FIG. 3 is a diagram illustrating a temporal change in transmission characteristics of the TFT in the first stress application step. From FIG. 3, it is confirmed that a curve representing the transmission characteristics shifts to the right with time, that is, the threshold voltage of the TFT shifts in the positive direction.

Figure 4:
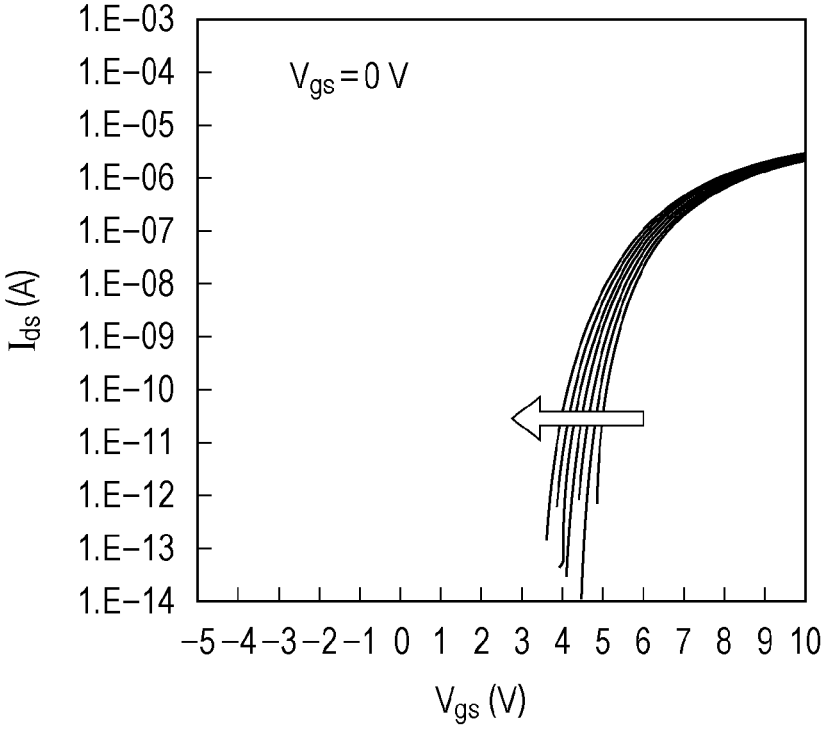
FIG. 4 is a graph illustrating a temporal change in the transmission characteristics of the TFT when no stress is applied to the TFT.

FIG. 4 is a diagram illustrating a temporal change in the transmission characteristics of the TFT in the first no-stress application step that follows the first stress application step. From FIG. 4, it is confirmed that a curve representing the transmission characteristics shifts to the left with time, that is, the threshold voltage of the TFT shifts in the negative direction.

Figure 5:
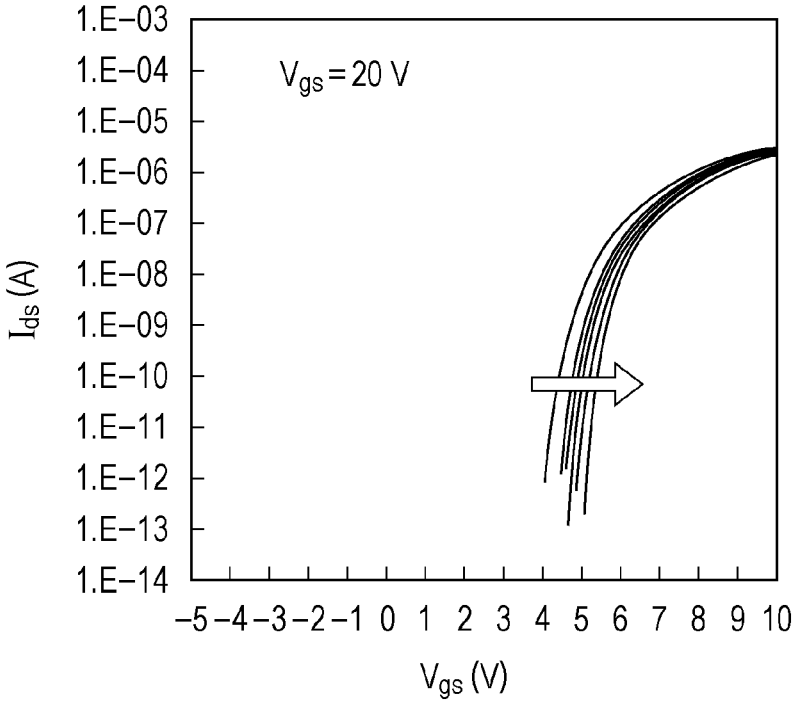
FIG. 5 is a graph illustrating a temporal change in the transmission characteristics of the TFT when stress is applied to the TFT.
Figure 6:
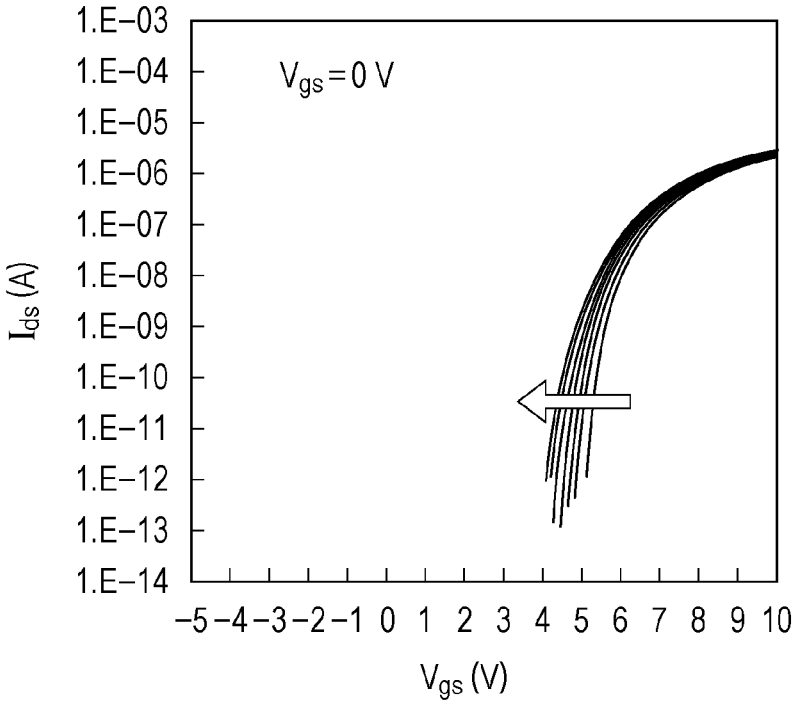
FIG. 6 is a graph illustrating a temporal change in the transmission characteristics of the TFT when no stress is applied to the TFT.
Figure 7:
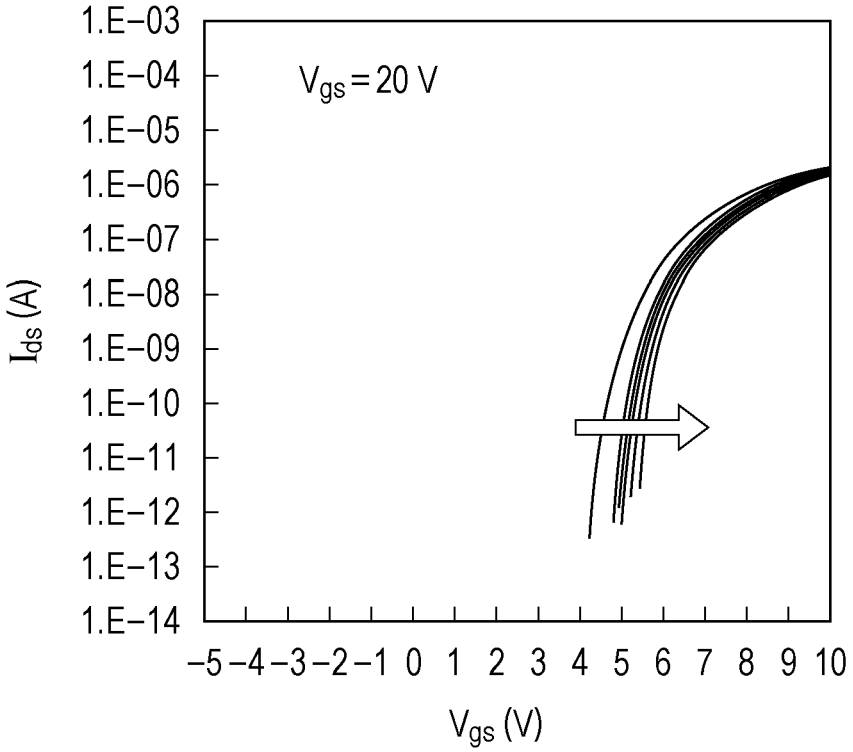
FIG. 7 is a graph illustrating a temporal change in the transmission characteristics of the TFT when stress is applied to the TFT.

FIGS. 5, 6, and 7 are diagrams illustrating a temporal change in the transmission characteristics of the TFT in the second stress application step, the second no-stress application step, and the third stress application step, respectively. Just like FIGS. 3 and 4, from FIGS. 5, 6, and 7, it is confirmed that the threshold voltage of the TFT shifts in the positive direction in the stress application step and that the threshold voltage of the TFT shifts in the negative direction, that is, the threshold voltage recovers, in the no-stress application step.

Figure 8:
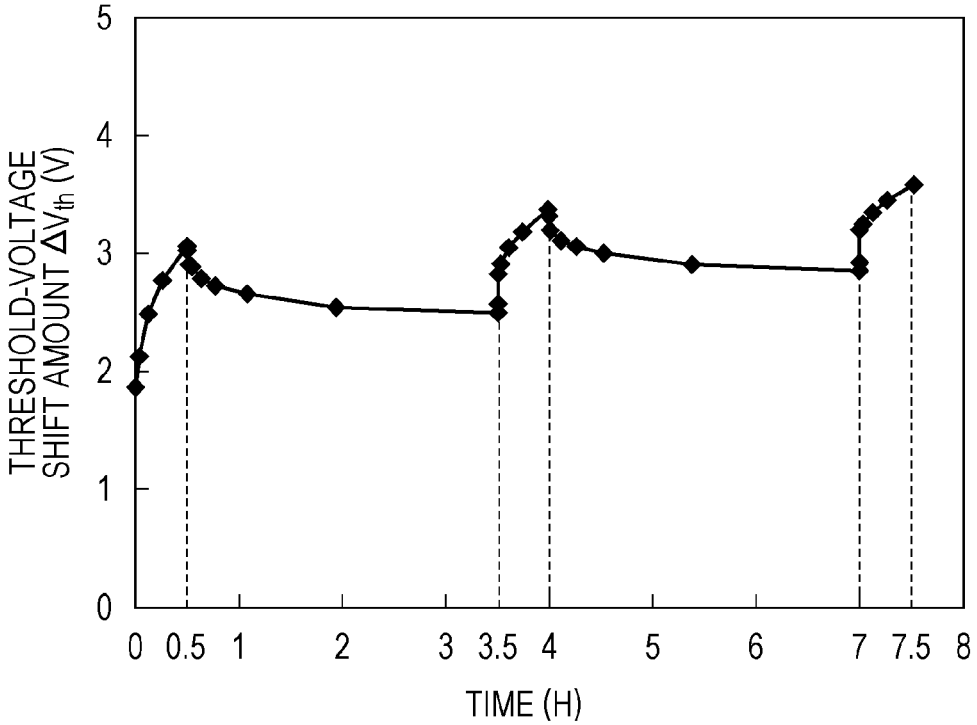
FIG. 8 is a graph illustrating a temporal change in the threshold-voltage shift amount of the TFT when a stress application step and a no-stress application step are alternately performed.

FIG. 8 is a graph illustrating a temporal change in the threshold-voltage shift amount $\Delta V_{th}$. As illustrated in FIG. 8, it is confirmed that the threshold voltage shifts in the positive direction during a stress period and the threshold voltage recovers and shifts in the negative direction during a no stress period.

Figure 9:
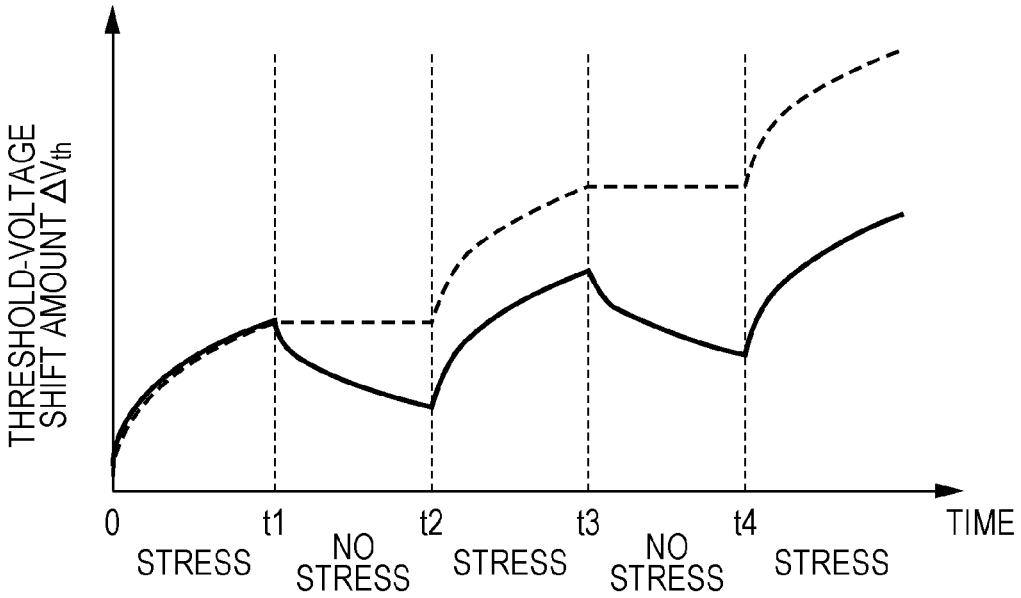
FIG. 9 is a graph illustrating the overview of a temporal change in the threshold-voltage shift amount of the TFT when the stress application step and the no-stress application step are alternately performed.
Figure 10:
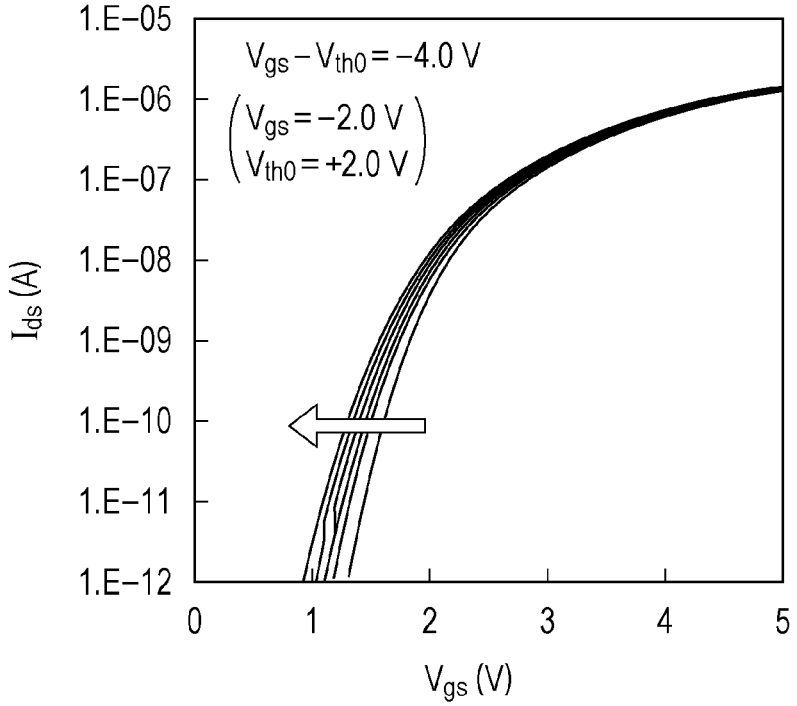
FIG. 10 is a graph illustrating a temporal change in the transmission characteristics of the TFT when stress is applied to the TFT.
Figure 11:
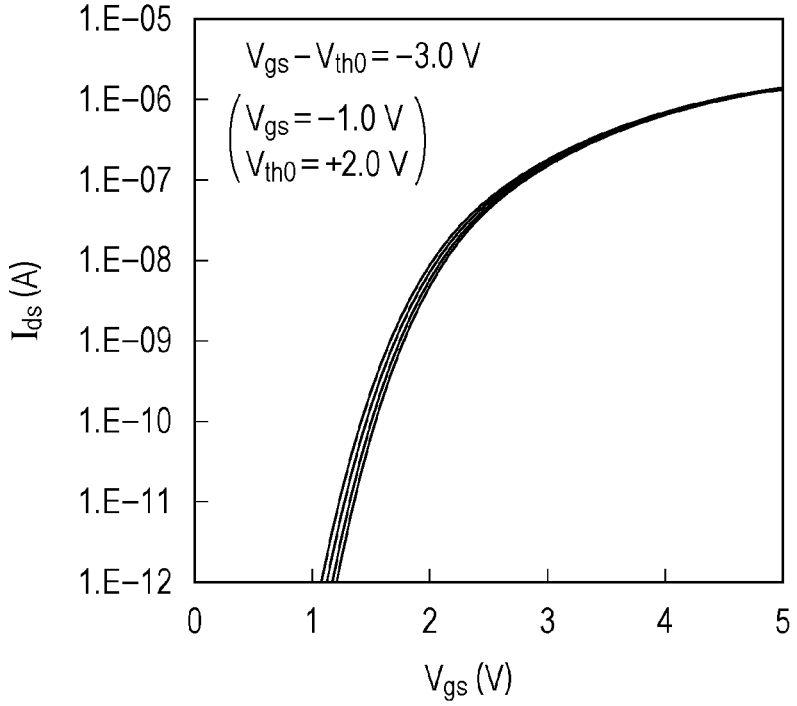
FIG. 11 is a graph illustrating a temporal change in the transmission characteristics of the TFT when stress is applied to the TFT.
Figure 12:
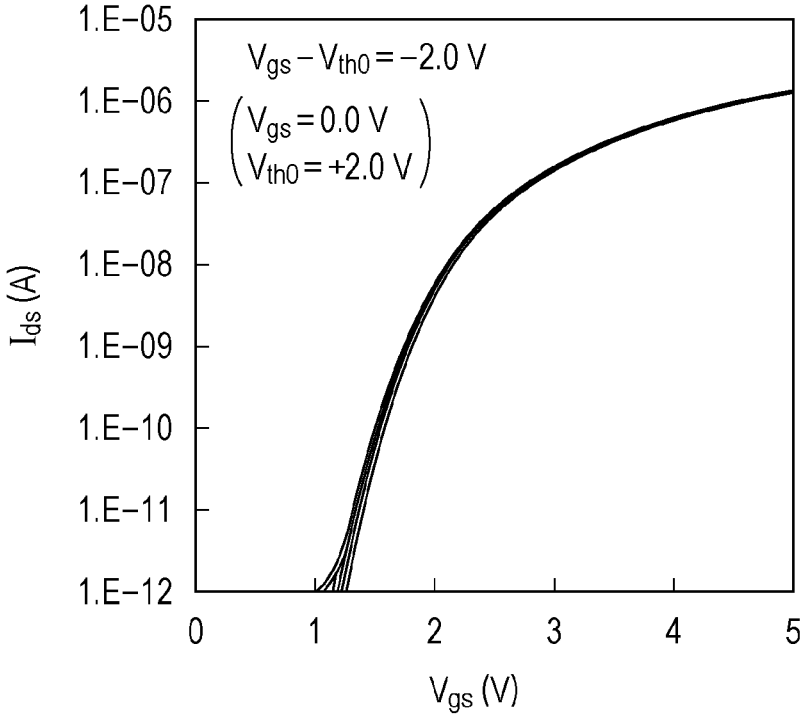
FIG. 12 is a graph illustrating a temporal change in the transmission characteristics of the TFT when stress is applied to the TFT.
Figure 13:
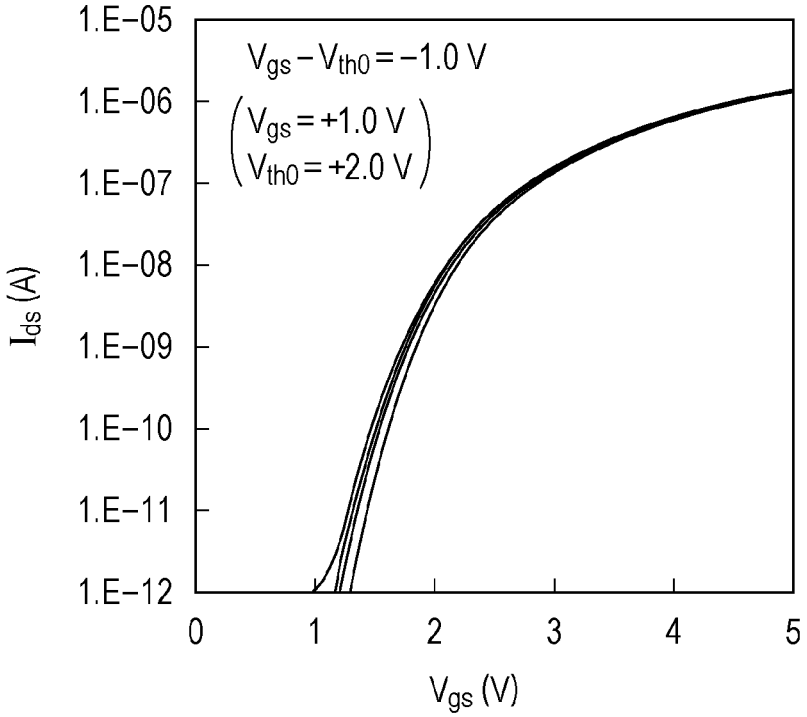
FIG. 13 is a graph illustrating a temporal change in the transmission characteristics of the TFT when stress is applied to the TFT.
Figure 14:
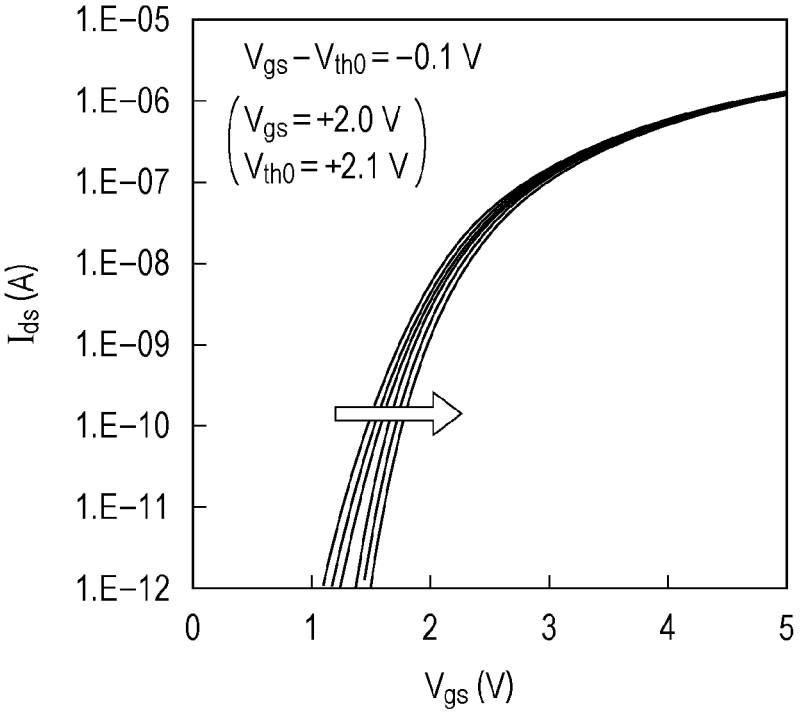
FIG. 14 is a graph illustrating a temporal change in the transmission characteristics of the TFT when stress is applied to the TFT.

Now, the shifted threshold voltage determined using the model such as the one illustrated in FIG. 2 and an actual shifted threshold voltage of the TFT are compared with each other. FIG. 9 is a graph illustrating the overview of threshold-voltage shifting that occurs when the stress application step and the no-stress application step are alternately performed on the TFT. FIG. 9 illustrates threshold-voltage shifting (broken line) determined based on the model and actual threshold-voltage shifting (solid line) of the TFT. As illustrated in FIG. 9, the shifted threshold voltage partially recovers in the no-stress application step in the actual TFT. However, the model does not take the influence of this recovery into consideration. For this reason, an error is caused between the threshold-voltage shift amount estimated from a cumulative amount of stress and the actual threshold-voltage shift amount, and this error accumulates with time. As a result, the estimated threshold-voltage shift amount deviates from the actual threshold-voltage shift amount more with time. For this reason, a desired amount of current is not undesirably supplied to an organic EL element when a video-signal-voltage offset determined based on the estimated threshold-voltage shift amount is used.

Display devices according to embodiments of the present disclosure which are capable of suppressing such an issue and driving methods for the same will be described below.

(Overview of Present Disclosure)

A display device according to an embodiment of the present disclosure comprises: a display unit including luminescence pixels each of which includes a luminescence element and a driving transistor, the driving transistor including a gate electrode, a source electrode, and a drain electrode, and being configured to supply a current to the luminescence element to cause the luminescence element to emit light; a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit in a case where a power supply to the signal line driving circuit is stopped. The control circuit is configured to apply the certain voltage between the gate electrode and the source electrode of the driving transistor so that a recovery of an amount of shift of a threshold voltage of the driving transistor is suppressed, the recovery being made in a period when the power supply to the signal line driving circuit is stopped.

With this display device, a recovery of the shifted threshold voltage of the driving transistor is suppressed while power supply to the signal line driving circuit is stopped. Accordingly, an error caused between the actual threshold-voltage shift amount of the driving transistor and the threshold-voltage shift amount estimated from the cumulative amount of stress can be suppressed. Further, by offsetting the gate-source voltage of the driving transistor by the threshold-voltage shift amount estimated from the cumulative amount of stress, the influence of threshold-voltage shifting can be suppressed.

Also, the display device according to the embodiment of the present disclosure may be configured such that the control circuit is configured to apply the certain voltage so that the amount of shift of the threshold voltage of the driving transistor in the period is smaller than a resolution of a voltage supplied by the signal line driving circuit.

With this configuration, the influence of threshold-voltage shifting on the signal voltage is reduced. Accordingly, the influence of threshold-voltage shifting on an amount of current supplied to an organic EL element is suppressed.

Also, the display device according to the embodiment of the present disclosure may be configured such that the control circuit is configured to apply the certain voltage so that the amount of shift of the threshold voltage of the driving transistor in the period is greater than or equal to −0.1 V and less than or equal to +0.1 V.

Also, the display device according to the embodiment of the present disclosure may further comprises a power line driving circuit controlled by the control circuit and may be configured such that the luminescence pixels each further include: a first power line connected to the drain electrode of the driving transistor; a first capacitor including a first electrode and a second electrode, the first electrode being connected to the gate electrode of the driving transistor and the second electrode being connected to the source electrode of the driving transistor; a second capacitor including a first electrode and a second electrode, the first electrode being connected to the second electrode of the first capacitor; a second power line connected to the second electrode of the second capacitor; a first switching element including a first terminal and a second terminal, the first terminal being connected to the gate electrode of the driving transistor; and a third power line connected to the second terminal of the first switching element. The power line driving circuit may apply voltages to the first power line, the second power line, and the third power line. And the control circuit may be configured to: receive a signal for stopping power supply to the signal line driving circuit; after receiving the signal, apply a voltage equal to the threshold voltage of the driving transistor between the gate electrode and the source electrode of the driving transistor; and after applying the voltage equal to the threshold voltage apply the certain voltage between the gate electrode and the source electrode of the driving transistor.

Also, the display device according to the embodiment of the present disclosure may be configured such that the luminescence pixels each further include a second switching element including a first terminal and a second terminal, the first terminal being connected to the source electrode of the driving transistor and the second terminal being connected to the second power line. And the control circuit may be configured to: make a potential at the second electrode of the first capacitor equal to a potential at the second power line by bringing the second switching element into a conductive state while keeping the first switching element in the conductive state and applying a voltage greater than or equal to the threshold voltage between the gate electrode and the source electrode of the driving transistor; and after making the potential equal to the potential at the second power line, apply the voltage equal to the threshold voltage of the driving transistor between the gate electrode and source electrode of the driving transistor by bringing the second switching element into a nonconductive state.

Also, the display device according to the embodiment of the present disclosure may be configured such that the control circuit is configured to: apply the voltage equal to the threshold voltage of the driving transistor between the gate electrode and the source electrode of the driving transistor by changing a voltage applied to the first power line while keeping the first switching element in the conductive state and applying a voltage greater than or equal to the threshold voltage between the gate electrode and the source electrode of the driving transistor.

Also, the display device according to the embodiment of the present disclosure may be configured such that the luminescence pixels each further include: a signal line to which a signal voltage is applied by the signal line driving circuit; and a third switching element including a first terminal and a second terminal, the first terminal being connected to the first electrode of the first capacitor and the second terminal being connected to the signal line. And the control circuit may be configured to apply the certain voltage between the gate electrode and the source electrode of the driving transistor by switching the third switching element from the nonconductive state into the conductive state after bringing the first switching element into the nonconductive state.

Also, the display device according to the embodiment of the present disclosure may be configured such that the control circuit is configured to apply the certain voltage between the gate electrode and the source electrode of the driving transistor by bringing the first switching element into the conductive state, after changing a voltage applied to the second power line while keeping the first switching element in the nonconductive state.

Also, the display device according to the embodiment of the present disclosure may be configured such that the control circuit is configured to apply the certain voltage between the gate electrode and the source electrode of the driving transistor by changing a voltage applied to the second power line while keeping the first switching element in the conductive state.

Also, the display device according to the embodiment of the present disclosure may be configured such that the control circuit is configured to apply the certain voltage between the gate electrode and the source electrode of the driving transistor by changing a voltage applied to the third power line while keeping the first switching element in the conductive state.

Also, the display device according to the embodiment of the present disclosure may be configured such that the driving transistor is a thin film transistor including a semiconductor layer composed of an oxide semiconductor.

Also, the display device according to the embodiment of the present disclosure may be configured such that a voltage obtained by subtracting the threshold voltage of the driving transistor from the certain voltage is greater than or equal to −4 V and less than or equal to 0 V.

In addition, a display device according to another embodiment of the present disclosure comprises: a display unit including luminescence pixels each of which includes a luminescence element and a driving transistor, the driving transistor including a gate electrode, a source electrode and a drain electrode, and being configured to supply a current to the luminescence element to cause the luminescence element to emit light; a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit. The control circuit may be configured to apply the certain voltage between the gate electrode and the source electrode of the driving transistor so that a voltage obtained by subtracting a threshold voltage of the driving transistor from the certain voltage becomes greater than or equal to −4 V and less than or equal to 0 V, before a power supply to the signal line driving circuit is stopped, and after the control circuit has received a signal for stopping the power supply to the signal line driving circuit.

With this display device, recovery of the shifted threshold voltage of the driving transistor is suppressed while power supply to the signal line driving circuit is stopped. Accordingly, an error caused between the actual threshold-voltage shift amount of the driving transistor and the threshold-voltage shift amount estimated from the cumulative amount of stress can be suppressed. Further, by offsetting the gate-source voltage of the driving transistor by the threshold-voltage shift amount estimated from the cumulative amount of stress, the influence of threshold-voltage shifting may be suppressed.

Also, the display device according to the other embodiment of the present disclosure may be configured such that the threshold voltage of the driving transistor is a threshold voltage in a saturation region.

Further, a display device driving method according to still another embodiment of the present disclosure is a driving method for a display device that includes a display unit including luminescence pixels each of which includes a luminescence element and a driving transistor, the driving transistor including a gate electrode, a source electrode, and a drain electrode, and being configured to supply a current to the luminescence element to cause the luminescence element to emit light; a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit. The driving method causing the control circuit to apply the certain voltage between the gate electrode and the source electrode of the driving transistor in a case where a power supply to the signal line driving circuit is stopped so that a recovery of an amount of shift of a threshold voltage of the driving transistor is suppressed, the recovery being made in a period when the power supply to the signal line driving circuit is stopped.

With this display device driving method, recovery of the shifted threshold voltage of the driving transistor is suppressed while power supply to the signal line driving circuit is stopped. Accordingly, an error caused between the actual threshold-voltage shift amount of the driving transistor and the threshold-voltage shift amount estimated from the cumulative amount of stress can be suppressed. Further, by offsetting the gate-source voltage of the driving transistor by the threshold-voltage shift amount estimated from the cumulative amount of stress, the influence of threshold-voltage shifting can be suppressed.

(Method for Determining Gate-Source Voltage for Suppressing Variation in Threshold Voltage)

Prior to a description of embodiments, a method for determining a gate-source voltage for suppressing a variation in the threshold voltage of the driving transistor will be described first. Note that the following description will be given on the assumption that the threshold voltage is a threshold voltage in a saturation region. Specifically, the gate-source voltage is determined in the following manner.

[Definition of Threshold Voltage in Saturation Region ($V_{gs}-V_{th}<v_{ds}$)]

The threshold voltage $V_{th}$ in the saturation region ($V_{gs}-V_{th}<V_{ds}$) can be defined as a value of the gate-source voltage $V_{gs}$ corresponding to a point where a tangent to a $(I_{ds})^{1/2}-V_{gs}$ characteristics curve, which represents characteristics between the square root of the drain-source current ($(I_{ds})^{1/2}$) and the gate-source voltage ($V_{gs}$), at a $V_{gs}$ point that gives the maximum mobility in the $(I_{ds})^{1/2}-V_{gs}$ characteristics crosses a $V_{gs}$ voltage axis (x axis). Here, the mobility is obtained by substituting a gradient $d(I_{ds})^{1/2}/dV_{gs}$ of the $(I_{ds})^{1/2}-V_{gs}$ characteristics curve into Equation (1).

$$\mu = \frac{2L}{WC}\left(\frac{d\sqrt{I_{ds}}}{dV_{gs}}\right)^2 \quad (1)$$

Also, the gate-source voltage $V_{gs}$ for suppressing a variation in the threshold voltage of the driving transistor is hereinafter referred to as a "balancing voltage". As an example of a method for determining the balancing voltage, a method based on an experiment will be described here.

First, a TFT to which no stress is applied is prepared. Stress is applied by keeping a drain potential $V_d$ and a source potential $V_s$ at 0 V and keeping a gate potential $V_g$ at a certain value for three hours. In this experiment, a TFT including a gate insulating film which includes a 220-nm-thick silicon nitride film and a 50-nm-thick silicon oxide film, and a 90-nm-thick semiconductor layer which includes an oxide semiconductor was used. Also, as the gate potential $V_g$, −5.0 V, −4.0 V, −3.0 V, . . . , +3.0 V, +4.5 V, and +5.0 V were selected. The environmental temperature was kept at 90° C. Note that a temperature acceleration coefficient that is calculated using a thermal activation energy of approximately 400 meV for threshold-voltage shifting was converted into a stress time. According to the conversion, voltage stress at the environmental temperature of 90° C. for three hours, which were conditions of the experiment, is equivalent to voltage stress at an environmental temperature of 40° C. for several tens of hours.

Figure 15:
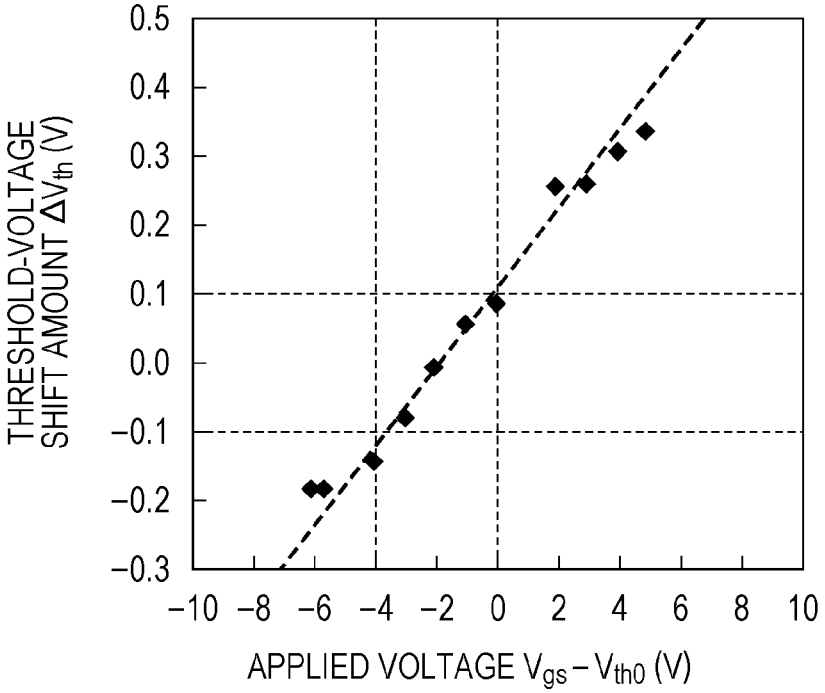
FIG. 15 is a graph illustrating a relationship between a voltage applied to the TFT and the threshold-voltage shift amount.

The results of this experiment will be described with reference to FIGS. 10 to 15. FIGS. 10 to 14 are graphs illustrating a temporal change in transmission characteristics when a difference between the gate-source voltage $V_{gs}$ and the initial threshold voltage $V_{th0}$ is −4.0 V, −3.0 V, −2.0 V, −1.0 V, and −0.1 V, respectively. As illustrated in FIGS. 10 to 14, the threshold-voltage shift amount $\Delta V_{th}$ becomes the smallest in the case of $V_{gs}-V_{th0}=-2.0$ V. Also, as the value of $V_{gs}-V_{th0}$ becomes smaller than −2.0 V, the threshold-voltage shift amount $\Delta V_{th}$ becomes larger in the negative direction. As the value of $V_{gs}-V_{th0}$ becomes larger than −2.0 V, the threshold-voltage shift amount $\Delta V_{th}$ becomes lager in the positive direction. FIG. 15 summarizes these experimental results and is a graph illustrating the dependency of the threshold-voltage shift amount $\Delta V_{th}$ on the applied voltage ($V_{gs}-V_{th0}$). Referring to FIG. 15, for example, when a tolerable range of the threshold-voltage shift amount $\Delta V_{th}$ is set to be greater than or equal to −0.1 V and less than or equal to +0.1 V, a tolerable range of ($V_{gs}-V_{th0}$) is greater than or equal to −4.0 V and less than or equal to 0.0 V. Here, the tolerable range of the threshold-voltage shift amount $\Delta V_{th}$ is decided on the basis of a resolution of a voltage applied by the signal line driving circuit for applying a signal voltage to the driving transistor. In typical display devices, because the signal line driving circuit has a maximum voltage of 16 V and grayscale levels of 6 bits (64 grayscale levels), the signal line driving circuit has a voltage resolution of 0.25 V. Accordingly, the influence of threshold-voltage shifting on the amount of current supplied to an organic EL element is suppressed by setting the threshold-voltage shift amount $\Delta V_{th}$ smaller than the voltage resolution. To this end, the tolerable range of the threshold-voltage shift amount $\Delta V_{th}$ can be set to make the threshold-voltage shift amount $\Delta V_{th}$ smaller than the voltage resolution. For example, as the tolerable range of the threshold-voltage shift amount $\Delta V_{th}$, a range greater than or equal to −0.1 V and less than or equal to +0.1 V can be selected as described above.

Referring now to the accompanying drawings, embodiments will be described in detail below. Note that a description that is more detailed than is necessary may be omitted. For example, a detailed description of already well known matters or a redundant description of substantially the same component may be omitted in order to avoid the following description from becoming unnecessarily redundant and make it easier for those skilled in the art to understand the present disclosure.

Note that the inventors provide the accompanying drawings and the following description in order to allow those skilled in the art to sufficiently understand the present disclosure, and do not intend to limit the subject recited in the claims to these drawings and description.

First Embodiment

A first embodiment of the present disclosure will be described below with reference to the accompanying drawings.

Figure 16:
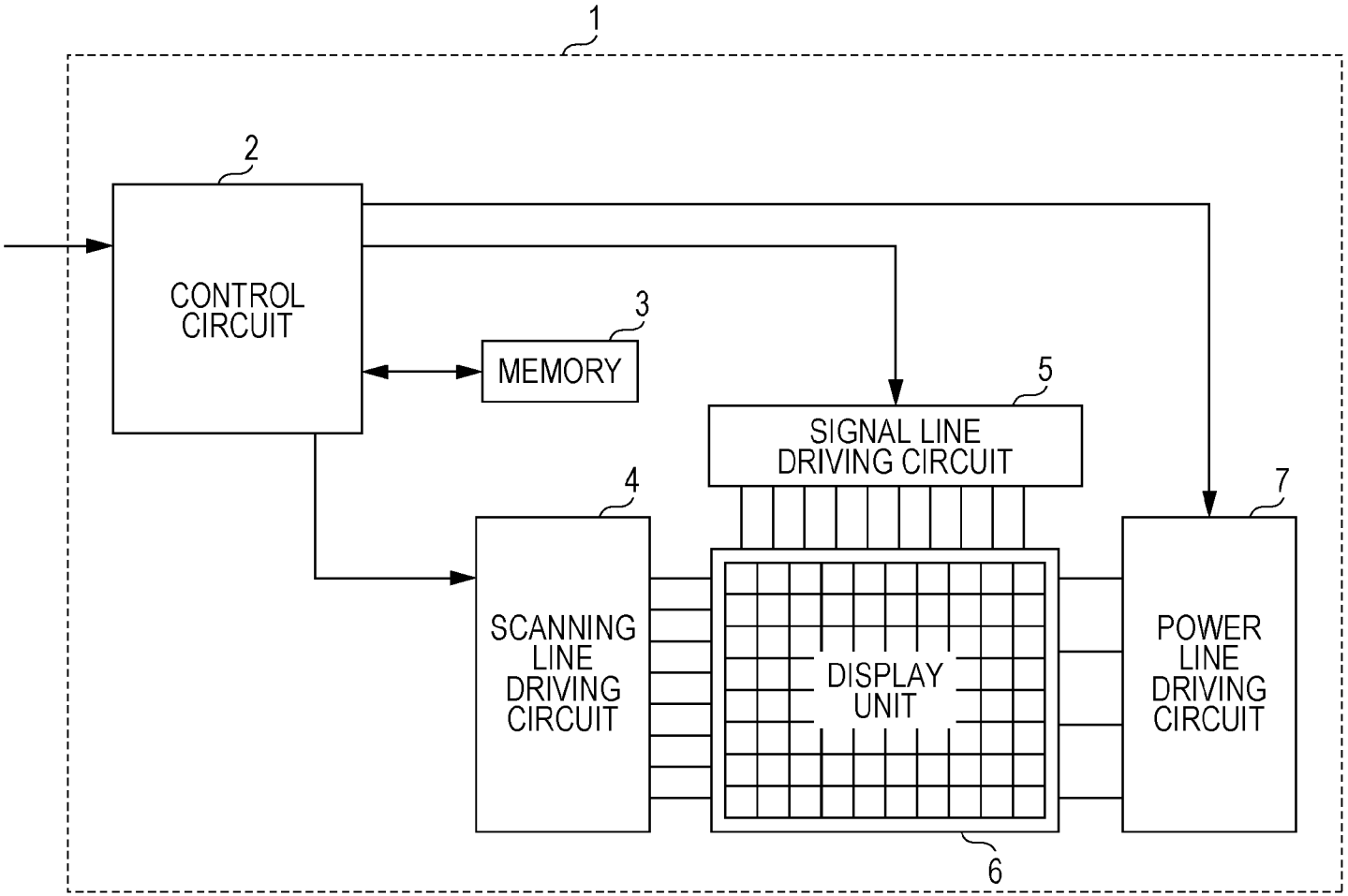
FIG. 16 is a block diagram illustrating an electrical configuration of a display device according to a first embodiment.

FIG. 16 is a block diagram illustrating an electrical configuration of a display device according to the first embodiment. A display device 1 illustrated in FIG. 1 includes a control circuit 2, a memory 3, a scanning line driving circuit 4, a signal line driving circuit 5, a display unit 6, and a power line driving circuit 7.

Figure 17:
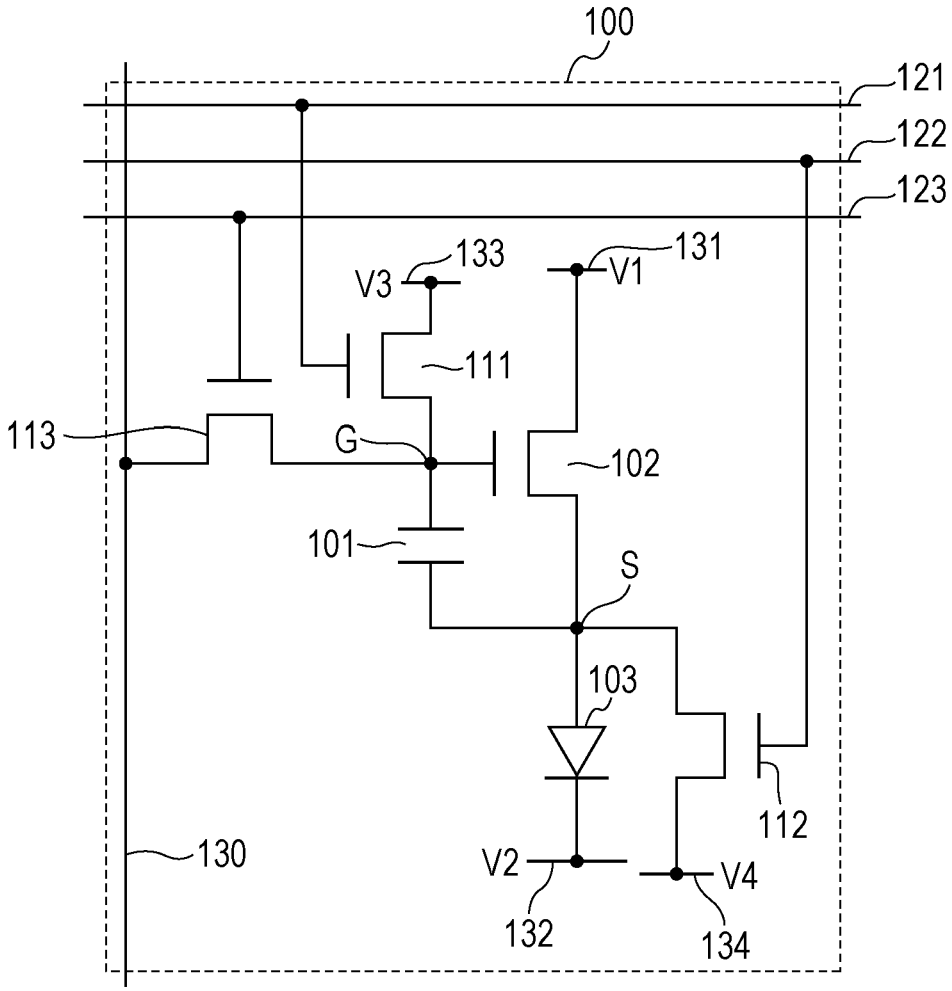
FIG. 17 is a circuit diagram illustrating a configuration of a luminescence pixel included in the display device according to the first embodiment.

FIG. 17 is a diagram illustrating a circuit configuration of a luminescence pixel included in the display unit 6 of the display device 1 according to the first embodiment. As illustrated in FIG. 17, a luminescence pixel 100 includes an organic EL element 103, a driving transistor 102, a first switching transistor 111, a second switching transistor 112, a third switching transistor 113, a first capacitor 101, a first scanning line 121, a second scanning line 122, a third scanning line 123, a signal line 130, a first power line 131, a second power line 132, a third power line 133, and a fourth power line 134.

The first scanning line 121, the second scanning line 122, and the third scanning line 123 are scanning lines configured to transfer scanning signals sent from the scanning line driving circuit 4 to the luminescence pixel 100.

The control circuit 2 is a circuit configured to control the scanning line driving circuit 4, the signal line driving circuit 5, the display unit 6, the power line driving circuit 7, and the memory 3. The memory 3 stores correction data, such as accumulated amounts of stress of individual luminescence pixels. The control circuit 2 reads out correction data that has been written in the memory 3. The control circuit 2 then corrects a video signal input from the outside in accordance with the correction data, and outputs the resulting video signal to the signal line driving circuit 5.

The scanning line driving circuit 4 is connected to the first scanning line 121, the second scanning line 122, and the third scanning line 123. The scanning line driving circuit 4 is a driving circuit having a function for controlling conduction/nonconduction of the first switching transistor 111, the second switching transistor 112, and the third switching transistor 113 included in each luminescence pixel 100 by outputting scanning signals to the first scanning line 121, the second scanning line 122, and the third scanning line 123.

The signal line driving circuit 5 is connected to the signal line 130. The signal line driving circuit 5 is a driving circuit having a function for outputting a signal voltage based on the video signal to each luminescence pixel 100.

The display unit 6 includes the multiple luminescence pixels 100, and displays an image based on the video signal input to the display device 1 from the outside.

The power line driving circuit 7 is connected to the first power line 131, the second power line 132, the third power line 133, and the fourth power line 134. The power line driving circuit 7 is a driving circuit having a function for applying, via each power line, a voltage to a corresponding element included in the luminescence pixel 100.

The driving transistor 102 is a driving element. The driving transistor 102 includes a gate electrode which is connected to a first electrode of the first capacitor 101, a source electrode which is connected to a second electrode of the first capacitor 101 and an anode electrode of the organic EL element 103, and a drain electrode which is connected to the first power line 131. The driving transistor 102 converts a voltage corresponding to a signal voltage applied between its gate and source into a drain current corresponding to the signal voltage. The driving transistor 102 then supplies this drain current as a signal current to the organic EL element 103. For example, an n-type TFT is used as the driving transistor 102.

The first switching transistor 111 is a switching element including a source electrode, a drain electrode, and a gate electrode which serves as a control terminal. The gate electrode is connected to the first scanning line 121. One of the source electrode and the drain electrode is connected to the gate electrode of the driving transistor 102. The other of the source electrode and the drain electrode is connected to the third power line 133.

The second switching transistor 112 is a switching element including a source electrode, a drain electrode, and a gate electrode which serves as a control terminal. The gate electrode is connected to the second scanning line 122. One of the source electrode and the drain electrode is connected to the source electrode of the driving transistor 102. The other of the source electrode and the drain electrode is connected to the fourth power line 134.

The third switching transistor 113 is a switching element including a source electrode, a drain electrode, and a gate electrode which serves as a control terminal. The gate electrode is connected to the third scanning line 123. One of the source electrode and the drain electrode is connected to the gate electrode of the driving transistor 102. The other of the source electrode and the drain electrode is connected to the signal line 130.

The first capacitor 101 is a capacitor element. The first capacitor 101 includes the first electrode which is connected to the gate electrode of the driving transistor 102 and the second electrode which is connected to the source electrode of the driving transistor 102. The first capacitor 101 holds electric charges corresponding to the signal voltage supplied from the signal line 130. The first capacitor 101 also has a function for controlling, in accordance with the video signal, the signal current to be supplied to the organic EL element 103 from the driving transistor 102 after the second switching transistor 112 and the third switching transistor 113 have entered a nonconductive state.

The organic EL element 103 is a luminescence element. The organic EL element 103 includes a cathode electrode which is connected to the second power line 132 and the anode electrode which is connected to the source electrode of the driving transistor 102. The organic EL element 103 emits light in accordance with the signal current that is controlled by the driving transistor 102.

One end of the signal line 130 is connected to the signal line driving circuit 5, and the other end of the signal line 130 is connected to individual luminescence pixels belonging to a pixel column including the luminescence pixel 100. The signal line 130 has a function for supplying a signal voltage corresponding to the video signal to each pixel.

The display device 1 includes as many signal lines 130 as the number of pixel columns.

One end of the first scanning line 121, one end of the second scanning line 122, and one end of the third scanning line 123 are connected to the scanning line driving circuit 4, and the other ends thereof are connected to individual luminescence pixels belonging to a pixel row including the luminescence pixel 100. With this configuration, the third scanning line 123 has a function for supplying a signal indicating a timing at which the signal voltage is to be written to the individual luminescence pixels belonging to the pixel row including the luminescence pixel 100. Also, the first scanning line 121 has a function for supplying a signal indicating a timing at which the threshold voltage of the driving transistor 102 included in the luminescence pixel 100 is to be detected, by causing a voltage V3 (reference voltage) of the third power line 133 to be applied to the gate electrode of the driving transistor 102. In addition, the second scanning line 122 has a function for initializing the first capacitor 101 and the organic EL element 103 of the luminescence pixel 100 in order to detect the threshold voltage of the driving transistor 102 of the luminescence pixel 100.

The first power line 131 is a power line used for applying a voltage V1 to the drain electrode of the driving transistor 102.

The second power line 132 is a power line used for applying a voltage V2 to the cathode electrode of the organic EL element 103.

The third power line 133 is a power line used for applying the voltage V3 (reference voltage) to the source electrode or drain electrode of the first switching transistor 111.

The fourth power line 134 is a power line used for initializing the source voltage of the driving transistor 102 to a voltage V4. The source electrode of the driving transistor 102 is connected to the first capacitor 101 and the organic EL element 103. Note that the voltage V4 may be a voltage at which the organic EL element 103 does not emit light, and may be set so that $V2-V4 \leq V_{th_EL}$ is satisfied, where $V_{th_EL}$ is a voltage at which the organic EL element 103 starts emitting light.

Now, a luminescent operation of the luminescence pixel 100 will be described.

First, the first switching transistor 111 is brought into a conductive state by a scanning signal supplied from the first scanning line 121. Then, the certain voltage V3 supplied from the third power line 133 is applied to the gate electrode of the driving transistor 102. In this way, the driving transistor 102 is brought into an off state so that no current flows between the source and the drain of the driving transistor 102.

Subsequently, the second switching transistor 112 is brought into the conductive state by a scanning signal supplied from the second scanning line 122, while keeping the first switching transistor 111 in the conductive state. This operation consequently makes the gate-source voltage of the driving transistor 102 substantially equal to V3-V4. Also, this operation allows the process to proceed to an operation for detecting the threshold voltage ($V_{th_TFT}$) of the driving transistor 102.

Here, the voltage V3 is set so that $V3-V4 \geq V_{th_TFT}$ and $V3-V2 \leq V_{th_EL}+V_{th_TFT}$ are satisfied. This setting along with the above-described condition of $V2-V4 \leq V_{th_EL}$ can bring the organic EL element 103 into a non-luminescent state at completion of a period over which the threshold voltage of the driving transistor 102 is detected, while allowing the organic EL element 103 to function as a capacitance by bringing the organic EL element 103 into a reverse bias state. That is, the threshold-voltage detection operation can be executed stably.

Then, the second switching transistor 112 is brought into the nonconductive state by the scanning signal supplied from the second scanning line 122, while keeping the first switching transistor 111 in the conductive state. At this instant, the gate-source voltage of the driving transistor 102 is $V3-V4 \geq V_{th_TFT}$. Accordingly, the driving transistor 102 is in the conductive state. The drain-source current of the driving transistor 102 flows through the reverse-biased organic EL element 103 and the first capacitor 101, in response to which, the organic EL element 103 and the first capacitor 101 are charged and the potential at the source electrode of the driving transistor 102 rises. Upon the gate-source voltage of the driving transistor 102 ultimately becoming substantially equal to $V_{th_TFT}$, that is, upon the potential at the source electrode of the driving transistor 102 becoming substantially equal to $V3-V_{th_TFT}$, the driving transistor 102 enters an off state. Then, charging of the organic EL element 103 and the first capacitor 101 with the drain-source current of the driving transistor 102 stops. As a result, the threshold voltage of the driving transistor 102 is held in the organic EL element 103 and the first capacitor 101.

Subsequently, the first switching transistor 111 is brought into the nonconductive state by the scanning signal supplied from the first scanning line 121.

Subsequently, the third switching transistor 113 is brought into the conductive state by the scanning signal supplied from the third scanning line 123. Then, a signal voltage ($V_{DATA}$) supplied from the signal line 130 is applied to the gate electrode of the driving transistor 102. At this time, the potential at the gate electrode of the driving transistor 102 changes from V3 to $V_{DATA}$. That is, a voltage of $(V_{DATA}-V3)\times(C_{el}/(C_{el}+C_s))+V_{th_TFT}$ is held in the first capacitor 101, where $C_{el}$ denotes a capacitance of the organic EL element 103 and $C_s$ denotes a capacitance of the first capacitor 101. This voltage is the gate-source voltage of the driving transistor 102. Accordingly, the drain-source current independent of the threshold voltage of the driving transistor 102 can be supplied to the organic EL element 103 from the driving transistor 102. At this time, the organic EL element 103 emits light.

As a result of the above-described series of operations, the organic EL element 103 emits light at a luminance corresponding to the signal voltage supplied from the signal line 130 over one frame period.

Figure 18:
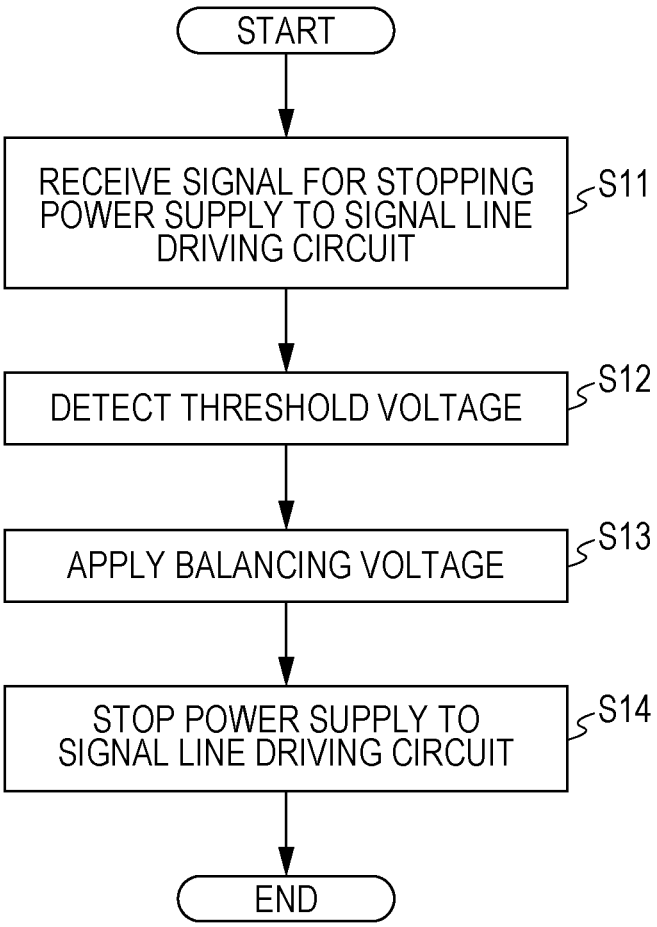
FIG. 18 is a flowchart illustrating the overview of an operation performed by the display device according to the first embodiment when a balancing voltage is applied.

Next, an operation performed when the balancing voltage is applied will be described. FIG. 18 is a flowchart illustrating the overview of an operation performed by the control circuit 2 when the balancing voltage is applied.

As illustrated in FIG. 18, the control circuit 2 first receives a signal for stopping power supply to the signal line driving circuit 5 (S11). Here, the signal for stopping power supply to the signal line driving circuit 5 is sent, for example, when a main power switch of the display device 1 is turned off. Upon receipt of the signal for stopping power supply to the signal line driving circuit 5, the control circuit 2 detects the threshold voltage (S12). Here, detection of the threshold voltage indicates making the gate-source voltage of the driving transistor 102 substantially equal to the threshold voltage. Next, the control circuit 2 applies a balancing voltage between the gate and the source of the driving transistor 102 (S13). After completing application of the balancing voltage, the control circuit 2 stops power supply to the signal line driving circuit 5 (S14).

The above-described threshold-voltage detection step (S12) and balancing-voltage application step (S13) will be described below.

Figure 19:
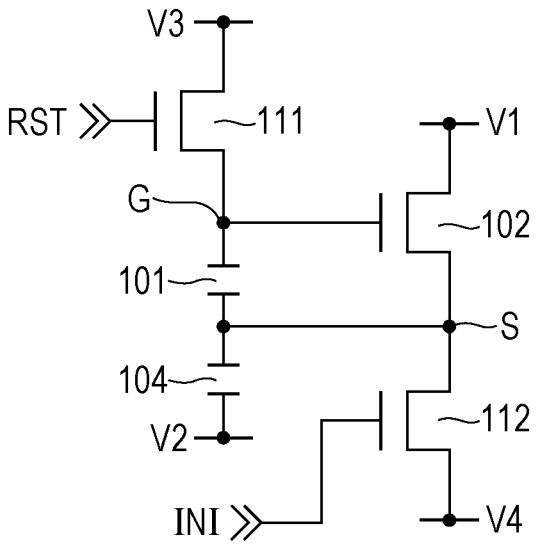
FIG. 19 is a circuit diagram illustrating elements used in the luminescence pixel in a threshold-voltage detection step according to the first embodiment.
Figure 20:
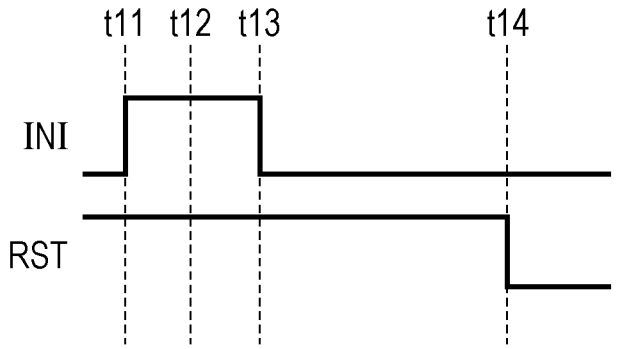
FIG. 20 is a timing chart illustrating an operation performed by the display device according to the first embodiment in the threshold-voltage detection step.

First, the threshold-voltage detection step (S12) will be described with reference to FIGS. 19 and 20. FIG. 19 is a circuit diagram illustrating some elements included in the luminescence pixel 100 illustrated in FIG. 17. Also, FIG. 20 is a timing chart illustrating an operation performed by the circuit illustrated in FIG. 19. Note that, in the circuit illustrated in FIG. 19, the source electrode of the driving transistor 102 is connected to a second capacitor 104. A new element may be added as the second capacitor 104, or a capacitance component of the organic EL element 103 may be used as the second capacitor 104. As for voltages applied to the first to fourth power lines 131 to 134, for example, 10 V, 0 V, 2.5 V, and 0 V may be selected as the voltages V1, V2, V3, and V4, respectively. Note that the voltage V3−V2 is set to be greater than the threshold voltage $V_{th}$ of the driving transistor 102.

Referring to FIGS. 19 and 20, INI denotes a signal applied to the gate electrode of the second switching transistor 112 and RST denotes a signal applied to the gate electrode of the first switching transistor 111.

As illustrated in FIG. 20, the control circuit 2 first sets the signals RST and INI to a high level at time t11 to bring the first switching transistor 111 and the second switching transistor 112 into the conductive state. Consequently, the source potential of the driving transistor 102 becomes substantially equal to V2 (=0 V) and the gate potential of the driving transistor 102 becomes substantially equal to V3 (=2.5 V). Accordingly, the voltage of V3−V2 (=2.5 V) is applied between the ends of the first capacitor 101, and the voltage applied to the second capacitor 104 becomes substantially equal to zero (V2=V4=0). This state is maintained up until time t13. At time t13, the signal INI alone is set to a low level. In response to this change, a current flows from the drain to the source of the driving transistor 102 because the gate-source voltage of the driving transistor 102 is greater than the threshold voltage $V_{th}$. At this time, the second capacitor 104 is charged, and the source potential of the driving transistor 102 rises. Then, the gate-source voltage of the driving transistor 102 becomes substantially equal to the threshold voltage $V_{th}$ of the driving transistor 102, that is, the source potential becomes substantially equal to $V3-V_{th}$. In response to this change, the nonconductive state occurs between the drain and the source of the driving transistor 102, and the rise in the source potential stops.

In the above-described manner, the threshold voltage $V_{th}$ of the driving transistor 102 can be detected. Also, at time t14 which is after the completion of detection of the threshold voltage $V_{th}$, the signal RST may be set to the low level.

Alternatively, the signal RST may be kept at the low level up until time t12 which is between time t11 and time t13. In this case, the voltage applied to the second capacitor 104 becomes substantially equal to zero at a timing between time t11 and time t12. The voltage applied to the first capacitor 101 becomes substantially equal to V3-V2 at a timing between time t12 and time t13. Accordingly, also in the case where the signal RST is kept at the low level from time t11 up until time t12, the threshold voltage $V_{th}$ of the driving transistor 102 can be detected.

Figure 21:
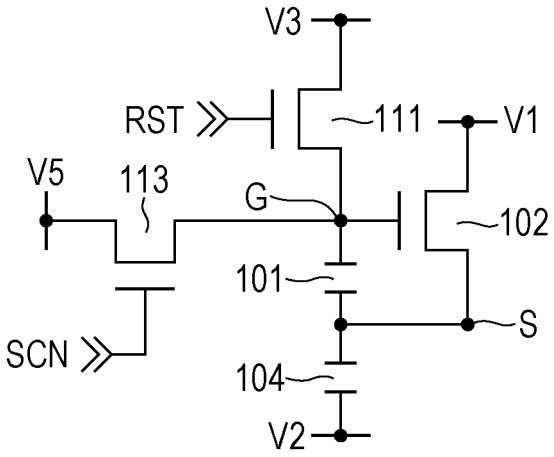
FIG. 21 is a circuit diagram illustrating elements used in the luminescence pixel in a balancing-voltage application step according to the first embodiment.
Figure 22:
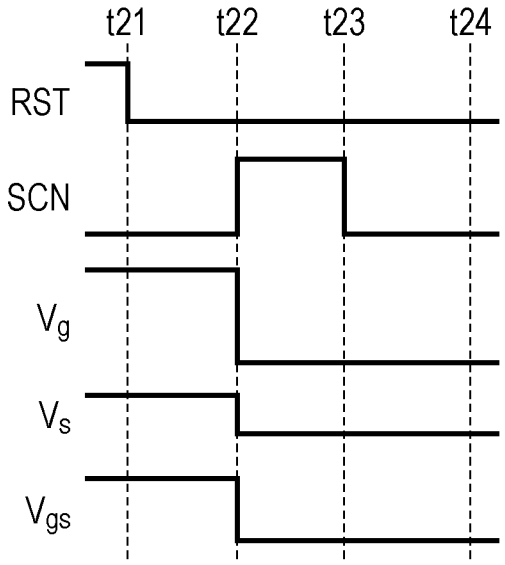
FIG. 22 is a timing chart illustrating an operation performed by the display device according to the first embodiment in the balancing-voltage application step.

Next, the balancing-voltage application step (S13) will be described with reference to FIGS. 21 and 22. FIG. 21 is a circuit diagram illustrating elements used in the luminescence pixel 100 illustrated in FIG. 17 in the balancing-voltage application step (S13). Also, FIG. 22 is a timing chart illustrating an operation performed by the circuit illustrated in FIG. 21. Note that in the circuit illustrated in FIG. 21, the source electrode of the driving transistor 102 is connected to the second capacitor 104. A new element may be added as the second capacitor 104, or a capacitance component of the organic EL element 103 may be used as the second capacitor 104. As for voltages applied to the first to third power lines 131 to 133, for example, 10 V, 0 V, and 2.5 V may be selected as the voltages V1, V2, and V3, respectively. Note that a voltage V5 applied to the signal line 130 may be set to 0 V, for example.

Referring to FIGS. 21 and 22, SCN denotes a signal applied to the gate electrode of the third switching transistor 113. As illustrated in FIG. 22, the control circuit 2 sets the signal RST to the low level at time t21 to bring the first switching transistor 111 into the nonconductive state from the conductive state. Note that at time t21, the above-described threshold-voltage detection step (S12) has been completed, and the source potential $V_s$ and the gate potential $V_g$ of the driving transistor 102 are substantially equal to $V3-V_{th}$ and V3, respectively. Subsequently, the control circuit 2 changes the signal SCN from the low level to the high level at time t22. In response to this change, the gate potential $V_g$ of the driving transistor 102 lowers from V3 (=2.5 V) to V5 (=0 V) by a potential difference of V3−V5 (=2.5 V) as illustrated in FIG. 22. At this time, the voltage applied between the ends of the first capacitor 101 changes. Here, capacitances of the first capacitor 101 and the second capacitor 104 are selected to achieve a ratio of 1:4, for example. In this case, a ratio between changes in voltages applied to the first capacitor 101 and the second capacitor 104 is 4:1. Accordingly, a decrease in voltage applied between the ends of the first capacitor 101 is substantially equal to 2 V, which is a ⅘ of (V3−V5). Therefore, the gate-source voltage $V_{gs}$ is substantially equal to $V_{th}-2$ at and after time t22. As a result, $V_{gs}-V_{th}$ becomes substantially equal to −2, and a state where the above-described optimum balancing voltage is applied between the gate and the source of the driving transistor 102 is achieved (see FIG. 15). Thereafter, the gate-source voltage of the driving transistor 102 is maintained even if the signal SCN is changed to the low level.

By operating the luminescence pixel 100 in the manner described above, the balancing voltage is applied between the gate and the source of the driving transistor 102 in the case where power supply to the signal line driving circuit 5 is stopped. With this configuration, recovery of the shifted threshold voltage of the driving transistor 102 while power supply to the signal line driving circuit 5 is stopped is suppressed. Accordingly, an error caused between the actual threshold-voltage shift amount of the driving transistor 102 and the threshold-voltage shift amount estimated from the accumulated amount of stress can be suppressed. Further, by offsetting the gate-source voltage of the driving transistor 102 by the threshold-voltage shift amount estimated from the accumulated amount of stress, the influence of threshold-voltage shifting can be suppressed.

Note that the above-described balancing voltage may be collectively applied to all luminescence pixels of the display unit 6 or may be sequentially applied to individual luminescence pixels.

Second Embodiment

Figure 23:
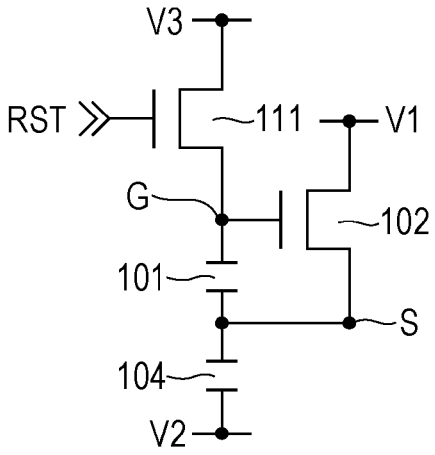
FIG. 23 is a circuit diagram illustrating elements used in the luminescence pixel in the balancing-voltage application step according to a second embodiment.
Figure 24:
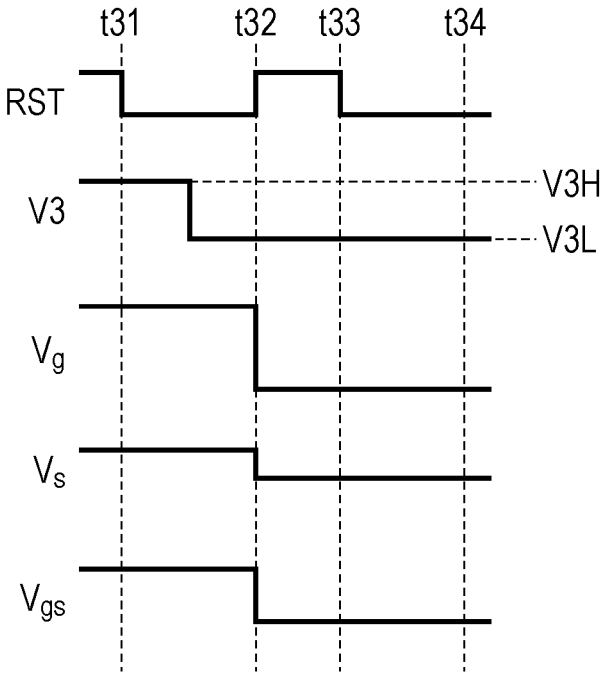
FIG. 24 is a timing chart illustrating an operation performed by the display device according to the second embodiment in the balancing-voltage application step.

Next, a second embodiment will be described with reference to FIGS. 23 and 24. FIG. 23 is a circuit diagram illustrating elements used in the luminescence pixel 100 illustrated in FIG. 17 in the balancing-voltage application step (S13). Also, FIG. 24 is a timing chart illustrating an operation performed by the circuit illustrated in FIG. 23 in the balancing-voltage application step (S13). The second embodiment differs from the first embodiment in the operation performed in the balancing-voltage application step (S13). Note that in the second embodiment a ratio between capacitances of the first capacitor 101 and the second capacitor 104 is set to 1:4, for example, as in the first embodiment. Also, as for voltages applied to the first and second power lines 131 and 132, for example, 10 V and 0 V may be selected as the voltages V1 and V2, respectively. The voltage V3 may be switched between the high level and the low level, and 2.5 V and 0 V may be selected as a high-level value V3H and a low-level value V3L, respectively.

As illustrated in FIG. 24, the control circuit 2 first switches the signal RST into the low level at time t31 to bring the first switching transistor 111 into the nonconductive state from the conductive state. Note that at time t31, the above-described threshold-voltage detection step (S12) has been completed, and the source potential $V_s$ and the gate potential $V_g$ of the driving transistor 102 are substantially equal to V3H−$V_{th}$ and V3H, respectively. Subsequently, at a timing between time t31 and time t32, the voltage V3 is switched into V3L from V3H. Thereafter, at time t32, the signal RST is switched into the high level from the low level. In response to this switching, the gate potential $V_g$ of the driving transistor 102 lowers from the V3H (=2.5 V) to V3L (=0V) by a potential difference of V3H−V3L (=2.5) as illustrated in FIG. 24. At this time, the voltage applied between the ends of the first capacitor 101 changes. Accordingly, the gate-source voltage $V_{gs}$ of the driving transistor 102 is substantially equal to $V_{th}$−2 at and after time t32, as in the first embodiment. As a result, $V_{gs}-V_{th}=-2$ is satisfied, and a state where the above-described balancing voltage is applied between the gate and the source of the driving transistor 102 is achieved. Thereafter, the gate-source voltage $V_{gs}$ of the driving transistor 102 is maintained even if the signal RST is switched to the low level at time t33.

Note that similar advantages can be obtained if the signal RST is kept at the high level over a period from time t31 to time t32. Also, the above-described balancing voltage may be collectively applied to all luminescence pixels of the display unit 6 or may be sequentially applied to individual luminescence pixels.

As described above, advantages similar to those of the first embodiment are obtained also in the second embodiment.

Third Embodiment

Figure 25:
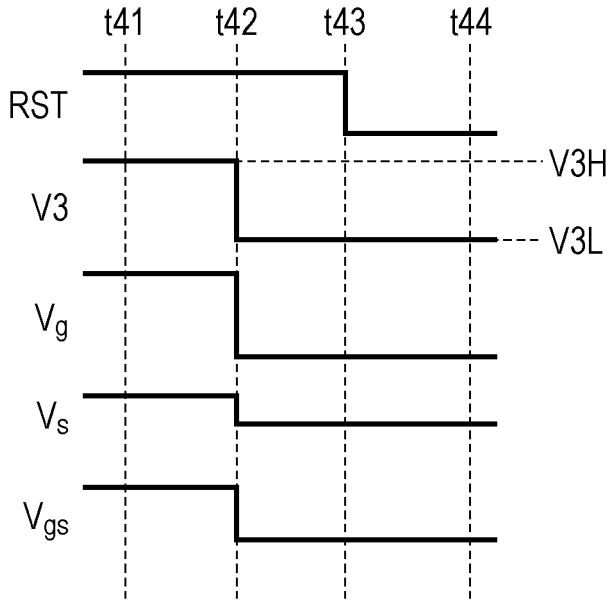
FIG. 25 is a timing chart illustrating an operation performed by the display device according to a third embodiment in the balancing-voltage application step.

Next, a third embodiment will be described with reference to FIG. 25. FIG. 25 is a timing chart illustrating an operation performed by the circuit illustrated in FIG. 23 in the balancing-voltage application step (S13) according to the third embodiment. The third embodiment differs from the second embodiment in timings at which the voltage V3 and the signal RST are switched in the balancing-voltage application step (S13). The second embodiment employs a configuration in which the signal RST illustrated in FIG. 24 is used in order to lower the gate potential $V_g$ of the driving transistor 102 from V3H to V3L. In the third embodiment, in place of the configuration of using the signal RST, a configuration in which the voltage V3 is switched from V3H to V3L in the manner illustrated in FIG. 25 is employed. Advantages similar to those of the above-described embodiments are obtained also in the third embodiment.

Fourth Embodiment

Figure 26:
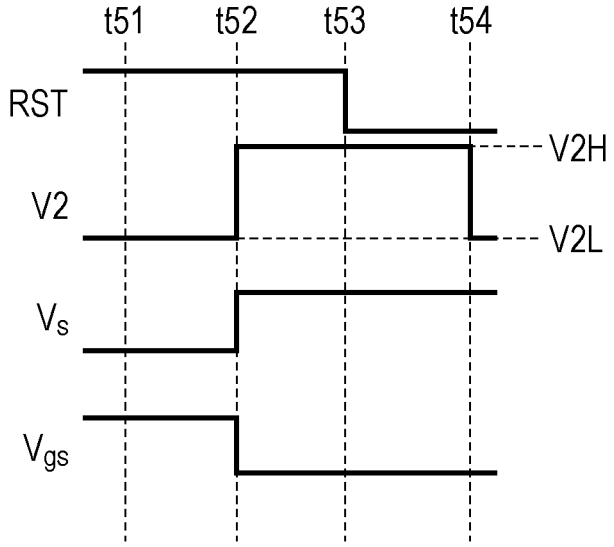
FIG. 26 is a timing chart illustrating an operation performed by the display device according to a fourth embodiment in the balancing-voltage application step.

Next, a fourth embodiment will be described with reference to FIG. 26. FIG. 26 is a timing chart illustrating an operation performed by the circuit illustrated in FIG. 23 in the balancing-voltage application step (S13) according to the fourth embodiment. The fourth embodiment differs from the above-described third embodiment in operation on the power line in the balancing-voltage application step (S13). As illustrated in FIG. 26, the fourth embodiment employs a configuration of switching the voltage V2 from V2L (=0 V) into V2H (=2.5 V) at time t52 in order to lower the gate-source voltage $V_{gs}$ of the driving transistor 102, in place of the configuration of lowering the gate potential $V_g$. Advantages similar to those of the above-described embodiments are obtained also in the fourth embodiment.

Fifth Embodiment

Figure 27:
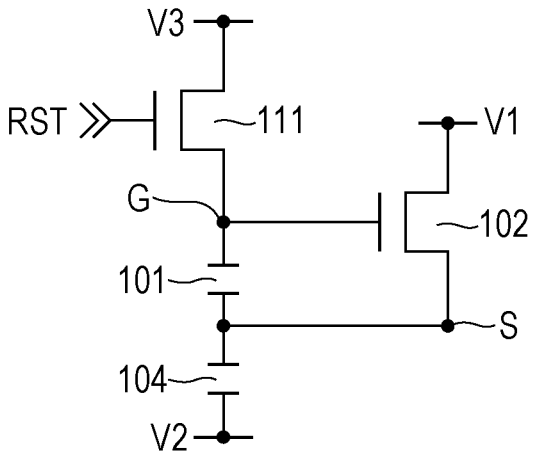
FIG. 27 is a circuit diagram illustrating elements used in the luminescence pixel in the threshold-voltage detection step according to a fifth embodiment.
Figure 28:
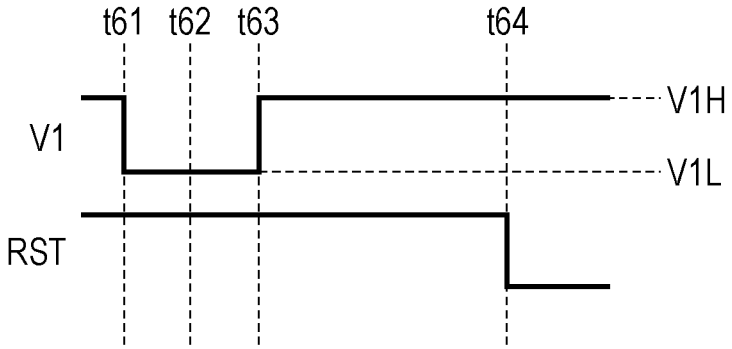
FIG. 28 is a timing chart illustrating an operation performed by the display device according to the fifth embodiment in the threshold-voltage detection step.

Next, a fifth embodiment will be described with reference to FIGS. 27 and 28. FIG. 27 is a circuit diagram illustrating elements used in the luminescence pixel 100 illustrated in FIG. 17 in the threshold-voltage detection step (S12) according to the fifth embodiment. FIG. 28 is a timing chart illustrating an operation performed by the circuit illustrated in FIG. 27 in the threshold-voltage detection step (S12) according to the fifth embodiment. The fifth embodiment differs from the above-described embodiments in operation performed by the circuit in the threshold-voltage detection step (S12). As for the voltages applied to the second and third power lines 132 and 133, for example, 0 V and 2.5 V can be selected as the voltages V2 and V3, respectively. Also, the voltage V1 is switched between the high level and the low level, and 10 V and 0 V can be selected as its high level value V1H and low level value V1L, respectively. Note that the voltage V3−V2 is set to be greater than the threshold voltage $V_{th}$ of the driving transistor 102, which is the same as the first embodiment.

As illustrated in FIG. 28, up until time t61, the signal RST and the voltage V1 are kept at the high level, and the gate potential $V_g$ of the driving transistor 102 is substantially equal to V3 (=2.5 V). Accordingly, up until time t61, the source potential $V_s$ of the driving transistor 102 is positive. At time t61, the voltage V1 is switched from V1H (=10 V) to V1L (=0 V). In response to this switching, the source potential $V_s$ of the driving transistor 102 becomes higher than the drain potential $V_d$, bringing the source-drain into the conductive state. As a result, a current flows from the source to the drain. After the source potential $V_s$ becomes substantially equal to the drain potential $V_d$ and an amount of current that flows from the drain to the source becomes substantially equal to zero, the voltage V1 is switched from V1L to V1H at time t63. Here, the source-drain of the driving transistor 102 is in the conductive state, and thus a current flows from the drain to the source. At this time, the second capacitor 104 is charged, and the source potential $V_s$ of the driving transistor 102 rises. Upon the gate-source voltage $V_{gs}$ of the driving transistor 102 becoming substantially equal to the threshold voltage $V_{th}$ of the driving transistor 102 (that is, the source potential $V_s$ becoming substantially equal to V3−$V_{th}$), the drain-source of the driving transistor 102 enters the nonconductive state and a rise in the source potential $V_s$ stops.

As described above, also in the fifth embodiment, the threshold voltage $V_{th}$ of the driving transistor 102 can be detected as in the first embodiment. Also, the signal RST can be switched to the low level at time t64 after a lapse of a sufficient period for detecting the threshold voltage $V_{th}$.

Note that as in the first embodiment, the signal RST may be kept at the low level up until time t62 which is between time t61 and time t63.

Also, in the fifth embodiment, any of the configurations according to the above-described embodiments can be employed as the configuration of the balancing-voltage application step (S13) which follows the threshold-voltage detection step (S13).

With this configuration, advantages similar to those of the above-described embodiments can be obtained also in the fifth embodiment.

OTHER EMBODIMENTS

As described above, the first to fifth embodiments have been described as illustrative examples of a technique of the present disclosure; however, the technique of the present disclosure is not limited to these embodiments, and is applicable to embodiments in which modification, replacement, addition, omission, or the like is appropriately made.

For example, the above-described embodiments have described the configuration in which the balancing voltage is applied before power supply to the signal line driving circuit 5 is stopped; however, a configuration may be employed in which detection of the threshold voltage and application of the balancing voltage are cyclically performed after power supply to the signal line driving circuit 5 has been stopped. With this configuration, in the case where the threshold voltage changes because of some reason while power supply to the signal line driving circuit 5 is stopped, an appropriate balancing voltage is applied again and a variation in the threshold voltage is further suppressed. Also, cycles at which the balancing voltage is applied may be set to be longer than the frame period of the display unit 6. With this configuration, power consumption due to application of the balancing voltage can be suppressed.

Also, materials of the semiconductor layers of the driving transistor 102 and the first to third switching transistors 111 to 113 used in the luminescence pixel 100 in the embodiments of the present disclosure are not limited to particular ones. For example, an oxide semiconductor material such as IGZO (In—Ga—Zn—O) may be employed. A transistor including a semiconductor layer composed of an oxide semiconductor such as IGZO has a small leakage current and thus is capable of keeping applying the balancing voltage for a long time. Also, in the case where transistors including semiconductor layers having positive threshold voltages are used as the first switching transistor 111 and the third switching transistor 113, a leakage current from the gate of the driving transistor 102 to the first switching transistor 111 and the third switching transistor 113 can be suppressed.

Also, in the embodiments, the threshold voltage may be a threshold voltage in a linear region. In this case, the threshold voltage is specifically determined in the following manner.

[Definition of Threshold Voltage in Linear Region ($V_{gs}-V_{th}$ $V_{ds}$)]

The threshold voltage $V_{th}$ in the linear region ($V_{gs}-V_{th}$ $V_{ds}$) can be defined as a value of the gate-source voltage $V_{gs}$ corresponding to a point where a tangent to a $I_{ds}-V_{gs}$ characteristics curve, which represents transmission characteristics (characteristics between the drain-source current ($I_{ds}$) and the gate-source voltage ($V_{gs}$)), at a $V_{gs}$ point that gives the maximum mobility in the $I_{ds}-V_{gs}$ characteristics crosses a $V_{gs}$ voltage axis (x axis). Here, the mobility is obtained by substituting a gradient $dI_{ds}/dV_{gs}$ of the curve of the transmission characteristics into Equation (2).

$$\mu = \frac{L}{WCV_{ds}}\left(\frac{dI_{ds}}{dV_{gs}}\right), \tag{2}$$

where L denotes a channel length, W denotes a channel width, and C denotes a gate capacitance per unit area.

Equation (2) is used in the linear region ($V_{gs}-V_{th}$ $V_{ds}$) and Equation (1) above is used in the saturation region ($V_{gs}-V_{th}<V_{ds}$) to calculate the mobility and the threshold voltage $V_{th}$. However, practically, if the threshold voltage $V_{th}$ is unknown, it is difficult to determine whether the current region is the linear region or the saturation region. Accordingly, the threshold voltage $V_{th}$ is temporarily determined using Equations (1) and (2), and then it is checked whether the current region is the linear region or the saturation region from the threshold voltage $V_{th}$. In this way, an appropriate threshold voltage can be determined with distinction between two operation regions.

Note that the threshold voltage may be a flat band voltage in a laminated structure of the gate electrode, the gate insulating film, and the semiconductor of the transistor.

Alternatively, the threshold voltage may be the minimum value of the $I_{ds}-V_{gs}$ curve.

Specifically, the threshold voltage may be a value of the gate-source voltage $V_{gs}$ corresponding to a point where a value of $$\frac{d\log(I_{ds})}{dV_{gs}} \tag{3}$$

becomes zero in transmission characteristics ($I_{ds}-V_{gs}$ characteristics) of the transistor.

Alternatively, the threshold voltage may be a value of the gate-source voltage $V_{gs}$ corresponding to a current value which is $1/2^n$ (n is a positive integer) of a peak current of the current $I_{ds}$, and the peak current may be a current value at the time of full white display.

In the above-described embodiments, a configuration of using n-type transistors as the driving transistors 102 is employed; however, advantages similar to those of the above-described embodiments can be obtained also in a display device that employs a configuration of using p-type transistors as the driving transistors 102 and in which polarities at the power lines or the like are inversed.

Also, in the above-described embodiments, an organic EL element is used as the luminescence element; however, any given luminescence element capable of changing its luminance intensity in accordance with current can be used.

In addition, the display device such as the above-described organic EL display device can be used as a flat panel display. Also, the display device is applicable to any display-device-equipped electronic devices such as television sets, personal computers, and mobile phones.

The present disclosure can be used for display devices and driving methods, and in particular to a display device such as a television set.

What is claimed is:

1. A display device comprising:

a display unit including luminescence pixels each of which includes a luminescence element and a driving transistor, the driving transistor including a gate electrode, a source electrode and a drain electrode, and being configured to supply a current to the luminescence element to cause the luminescence element to emit light;

a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit in a case where a power supply to the signal line driving circuit is stopped, wherein the control circuit is configured to apply the certain voltage between the gate electrode and the source electrode of the driving transistor so that a recovery of an amount of shift of a threshold voltage of the driving transistor is suppressed, the recovery being made in a period when the power supply to the signal line driving circuit is stopped.

2. The display device according to claim 1, wherein the control circuit is configured to apply the certain voltage so that the amount of shift of the threshold voltage of the driving transistor in the period is smaller than a resolution of a voltage supplied by the signal line driving circuit.

3. The display device according to claim 1, wherein the control circuit is configured to apply the certain voltage so that the amount of shift of the threshold voltage of the driving transistor in the period is greater than or equal to −0.1 V and less than or equal to +0.1 V.

4. The display device according to claim 1, further comprising:

a power line driving circuit controlled by the control circuit, wherein the luminescence pixels each further include:

a first power line connected to the drain electrode of the driving transistor;

a first capacitor including a first electrode and a second electrode, the first electrode being connected to the gate electrode of the driving transistor and the second electrode being connected to the source electrode of the driving transistor;

a second capacitor including a first electrode and a second electrode, the first electrode being connected to the second electrode of the first capacitor;

a second power line connected to the second electrode of the second capacitor;

a first switching element including a first terminal and a second terminal, the first terminal being connected to the gate electrode of the driving transistor; and a third power line connected to the second terminal of the first switching element, the power line driving circuit applies voltages to the first power line, the second power line, and the third power line, and the control circuit is configured to:

receive a signal for stopping power supply to the signal line driving circuit;

after receiving the signal, apply a voltage equal to the threshold voltage of the driving transistor between the gate electrode and the source electrode of the driving transistor; and after applying the voltage equal to the threshold voltage, apply the certain voltage between the gate electrode and the source electrode of the driving transistor.

5. The display device according to claim 4, wherein the luminescence pixels each further include a second switching element including a first terminal and a second terminal, the first terminal being connected to the source electrode of the driving transistor and the second terminal being connected to the second power line, and the control circuit is configured to:

make a potential at the second electrode of the first capacitor equal to a potential at the second power line by bringing the second switching element into a conductive state while keeping the first switching element in the conductive state and applying a voltage greater than or equal to the threshold voltage between the gate electrode and the source electrode of the driving transistor; and after making the potential equal to the potential at the second power line, apply the voltage equal to the threshold voltage of the driving transistor between the gate electrode and source electrode of the driving transistor by bringing the second switching element into a nonconductive state.

6. The display device according to claim 4, wherein the control circuit is configured to apply the voltage equal to the threshold voltage of the driving transistor between the gate electrode and the source electrode of the driving transistor by changing a voltage applied to the first power line while keeping the first switching element in the conductive state and applying a voltage greater than or equal to the threshold voltage between the gate electrode and the source electrode of the driving transistor.

7. The display device according to claim 4, wherein the luminescence pixels each further include:

a signal line to which a signal voltage is applied by the signal line driving circuit; and a third switching element including a first terminal and a second terminal, the first terminal being connected to the first electrode of the first capacitor and the second terminal being connected to the signal line, and the control circuit is configured to apply the certain voltage between the gate electrode and the source electrode of the driving transistor by switching the third switching element from the nonconductive state into the conductive state after bringing the first switching element into the nonconductive state.

8. The display device according to claim 4, wherein the control circuit is configured to apply the certain voltage between the gate electrode and the source electrode of the driving transistor by bringing the first switching element into the conductive state, after changing a voltage applied to the second power line while keeping the first switching element in the nonconductive state.

9. The display device according to claim 4, wherein the control circuit is configured to apply the certain voltage between the gate electrode and the source electrode of the driving transistor by changing a voltage applied to the second power line while keeping the first switching element in the conductive state.

10. The display device according to claim 4, wherein the control circuit is configured to:

apply the certain voltage between the gate electrode and the source electrode of the driving transistor by changing a voltage applied to the third power line while keeping the first switching element in the conductive state.

11. The display device according to claim 1, wherein the driving transistor is a thin film transistor including a semiconductor layer composed of an oxide semiconductor.

12. The display device according to claim 1, wherein a voltage obtained by subtracting the threshold voltage of the driving transistor from the certain voltage is greater than or equal to −4 V and less than or equal to 0 V.

13. A display device comprising:

a display unit including luminescence pixels each of which includes a luminescence element and a driving transistor, the driving transistor including a gate electrode, a source electrode and a drain electrode, and being configured to supply a current to the luminescence element to cause the luminescence element to emit light;

a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit, wherein the control circuit is configured to apply the certain voltage between the gate electrode and the source electrode of the driving transistor so that a voltage obtained by subtracting a threshold voltage of the driving transistor from the certain voltage becomes greater than or equal to −4 V and less than or equal to 0 V, before a power supply to the signal line driving circuit is stopped, and after the control circuit has received a signal for stopping the power supply to the signal line driving circuit.

14. The display device according to claim 13, wherein the threshold voltage of the driving transistor is a threshold voltage in a saturation region.

15. A driving method for a display device that includes: a display unit including luminescence pixels each of which includes a luminescence element and a driving transistor, the driving transistor including a gate electrode, a source electrode and a drain electrode, and being configured to supply a current to the luminescence element to cause the luminescence element to emit light; a signal line driving circuit configured to supply a voltage applied between the gate electrode and the source electrode of the driving transistor; and a control circuit configured to apply a certain voltage between the gate electrode and the source electrode of the driving transistor by controlling the signal line driving circuit and the display unit, the driving method causing the control circuit to apply the certain voltage between the gate electrode and the source electrode of the driving transistor in a case where a power supply to the signal line driving circuit is stopped so that a recovery of an amount of shift of a threshold voltage of the driving transistor is suppressed, the recovery being made in a period when the power supply to the signal line driving circuit is stopped.

* * * * *